US007921790B2

(12) United States Patent
Arai et al.

(10) Patent No.: US 7,921,790 B2
(45) Date of Patent: Apr. 12, 2011

(54) SHIP BUOYANCY CONTROL SYSTEM

(75) Inventors: Makoto Arai, Kanagawa (JP); Kazuo Suzuki, Kanagawa (JP); Koki Kora, Tokyo (JP)

(73) Assignee: National University Corporation Yokohama National University, Yokohama (JP)

( * ) Notice: Subject to any disclaimer, the term of this patent is extended or adjusted under 35 U.S.C. 154(b) by 0 days.

(21) Appl. No.: 12/448,112

(22) PCT Filed: Dec. 10, 2007

(86) PCT No.: PCT/JP2007/073761

§ 371 (c)(1),
(2), (4) Date: Jun. 9, 2009

(87) PCT Pub. No.: WO2008/069341

PCT Pub. Date: Jun. 12, 2008

(65) Prior Publication Data

US 2010/0018448 A1 Jan. 28, 2010

(30) Foreign Application Priority Data

Dec. 9, 2006 (JP) ..... 2006-332691

(51) Int. Cl.
*B63B 39/03* (2006.01)

(52) U.S. Cl. ..... 114/125

(58) Field of Classification Search ..... 114/125
See application file for complete search history.

(56) References Cited

U.S. PATENT DOCUMENTS

| | | | | |
|---|---|---|---|---|
| 3,503,358 | A * | 3/1970 | Moesly | 114/125 |
| 4,288,176 | A * | 9/1981 | Devine | 405/188 |
| 4,528,927 | A * | 7/1985 | Iizuka et al. | 114/125 |
| 6,053,121 | A | 4/2000 | Tamashima et al. | |
| 6,076,480 | A | 6/2000 | Chang, III et al. | |

FOREIGN PATENT DOCUMENTS

| | | |
|---|---|---|
| JP | 58-180960 | 12/1983 |
| JP | 2001-206280 | 7/2001 |
| JP | 2002-234487 | 8/2002 |

(Continued)

OTHER PUBLICATIONS

International Search Report issued on Mar. 18, 2008 in corresponding International Patent Application No. PCT/JP2007/073761.

(Continued)

*Primary Examiner* — Stephen Avila
(74) *Attorney, Agent, or Firm* — Staas & Halsey LLP

(57) ABSTRACT

A tank (10) of a ship (1) is provided with an inflow port (6) and an outflow port (7) opening through a bottom of the ship (13). The inflow and outflow ports are spaced apart from each other in a headway direction of the hull. The ports are equipped with closure means (9), which closes the ports so as to ensure hull buoyancy by means of air in the tank. The ports allow seawater outside the ship to flow into the tank through the inflow port and the seawater in the tank to flow out of the ship through the outflow port, with use of headway motion of the ship. A partition (2) provides a weir extending in a widthwise direction of the hull in the tank, and divides a region in the tank into an inflow area (3) and an outflow area (4). The tank, partition, inflow port, outflow port and closure means constitute a ship buoyancy control system.

19 Claims, 18 Drawing Sheets

FOREIGN PATENT DOCUMENTS

| | | |
|---|---|---|
| JP | 2002-331991 | 11/2002 |
| JP | 2004-284481 | 10/2004 |
| JP | 2006-007184 | 1/2006 |
| JP | 3121796 | 5/2006 |
| JP | 2006-188140 | 7/2006 |
| WO | 00/38972 | 7/2000 |
| WO | 03/010044 | 2/2003 |
| WO | 2004/039660 | 5/2004 |

OTHER PUBLICATIONS

Extended European Search Report for corresponding European Application 07850335.6-1254; dated Dec. 15, 2010.

* cited by examiner

| | |
|---|---|
| L | 20 m |
| L1 | 10 m |
| H | 10 m |
| h | 6 m |
| S1 | 1 m |
| S2 | 0.5m |
| α | 30° |
| | |

(F)

| | |
|---|---|
| L | 20 m |
| L1 | 10 m |
| H | 10 m |
| h | 6 m |
| S3 | 1 m |
| S4 | 0.5 |
| β | 30° m |
| | |

(A)

(B)

| | Position of Inflow Port | Position of Outflow Port | Presence or Absence of Partition | Seawater Exchange Rate [300s] |
|---|---|---|---|---|
| Case. 1 | X1 | X5 | Presence | 88.6% |
| Case. 2 | X2 | X5 | Presence | 85.9% |
| Case. 3 | X3 | X5 | Presence | 87.0% |
| Case. 4 | X4 | X2 | Presence | 58.8% |
| Case. 5 | X5 | X2 | Presence | 62.7% |
| Case. 6 | X6 | X2 | Presence | 76.5% |
| Case. 7 | X1 | X5 | Absence | 70.3% |
| Case. 8 | X2 | X5 | Absence | 63.0% |
| Case. 9 | X3 | X5 | Absence | 52.6% |
| Case.10 | X4 | X2 | Absence | 66.3% |
| Case.11 | X5 | X2 | Absence | 70.8% |
| Case.12 | X6 | X2 | Absence | 73.6% |

| | |
|---|---|
| L | 20 m |
| L1 | 10 m |
| L2 | 5 m |
| H | 10 m |
| h | 6 m |
| S1 | 1 m |
| | |
| | |

| | |
|---|---|
| L | 20 m |
| L1 | 10 m |
| H | 10 m |
| h | 6 m |
| S1 | 1 m |
| S3 | 1 m |
| | |
| | |

| | |
|---|---|
| L | 20 m |
| L1 | 10 m |
| L2 | 5 m |
| H | 10 m |
| h | 6 m |
| S1 | 1 m |
| S3 | 1 m |
| | |

(A)

(B)

SHIP BUOYANCY CONTROL SYSTEM

CROSS REFERENCE TO RELATED APPLICATIONS

This application claims the benefit under 35 U.S.C. Section 371, of PCT International Application No. PCT/JP2007/073761, filed Dec. 10, 2007, which claimed priority to Japanese Application No. 2006-332691, filed Dec. 9, 2006 in the Japanese Patent Office, the disclosures of which are hereby incorporated by reference.

TECHNICAL FIELD

The present invention relates to a ship buoyancy control system, and particularly to a ballast-free ship buoyancy control system which can be applied to a ballast water exchanger or a ballast water exchange method for exchanging ballast water for seawater outside the ship, or which can be applied to a hull structure of a ballast-free ship.

BACKGROUND ART

In general, when a ship is navigated in an unloaded or lightly loaded condition, the ship is charged with ballast water to ensure a predetermined draft so as to not only stabilize the hull but also prevent hull bottom slamming, propeller racing, and other undesirable phenomena. A ballast tank is typically charged with water at a cargo unloading point (cargo unloading place), and the water in the ballast tank is discharged at a cargo loading point (cargo loading place). Marine life at the cargo unloading point is transported along with the ballast water in the ballast tank to the cargo loading point and discharged into the waters at the cargo loading point. This results in change in the ecosystem, damage to the ecosystem, and other problems in the waters at the cargo loading point. Since ballast water is transported and discharged on a global scale, plankton and other marine life contained in ballast water are possibly transported to waters that are not their original habitats and seriously affect the ecosystems and industrial activities, such as fisheries, in those waters. The transportation of ballast water has therefore been taken into consideration as a global issue concerning marine environment protection and regarded as a serious problem particularly in recent years.

To solve such a problem, a variety of methods have been proposed, which includes a method for processing unnecessary ballast water in an on-land facility instead of discharging it into the sea, a method for sterilizing or purifying ballast water (e.g., JP-A-2004-284481, JP-A-2002-234487, and JP-A-2006-7184), and a method for forcibly performing offshore ballast water exchange with use of a pump or any other suitable circulation apparatus (e.g., JP-A-2002-331991 and JP-A-2001-206280).

When the method for processing unnecessary ballast water in an on-land facility is employed, however, an on-land facility for processing ballast water needs to be newly built. The method for sterilizing ballast water has not yet been put into practice because sterilization and purification have not been established as a technology for reliably trapping microorganisms. In the case of sterilization using chemicals, secondary contamination and other problems are also of concern. Therefore, on-land processing, sterilization, and purification of unnecessary ballast water still encounter difficult problems.

On the other hand, the ballast water exchange techniques for forcibly performing offshore ballast water exchange have been in actual use, which are known as a sequential method in which a ballast tank is completely emptied and then recharged with seawater; a flow-through method in which a ballast tank is charged with water and overflowed so that the ballast water is exchanged; and a dilution method in which a ballast tank is charged with water while the ballast water is discharged at the same time.

Any of the forced exchange methods as set forth above, however, requires installation of a seawater exchange system including a forced circulation apparatus and an inboard pipeline in the hull, and driving operation of the seawater exchange system to exchange seawater. At present, an achievable seawater exchange rate is approximately merely 83% even when the seawater exchange system introduces into the ballast tank, an amount of water that is three times as much as the capacity of the tank. In order to achieve a seawater exchange rate of 95% or higher, it is necessary to introduce into the ballast tank, an amount of seawater that is at least five times as much as the capacity of the tank. Therefore, if a sufficient seawater exchange rate is to be attained by a forced exchange type of ballast water exchanger, a large amount of fuel and power is consumed to drive a pump and other devices, and a large amount of time and manpower is needed for operation of the system.

An example of a ballast water exchanger which does not rely on a forced circulation apparatus or other powered apparatus is described, for example, in JP-A-11-29089 and JP-A-2005-536402, in which relatively high water pressure acting on a bow portion is used for intake of seawater.

DISCLOSURE OF THE INVENTION

Problems to be Solved by the Invention

However, in such a conventional ballast water exchanger, high water pressure acting on a bow portion during a voyage is used for introduction of seawater from the bow portion into a ballast tank, but the area of a water intake opening at the bow portion should be limited so as not to affect the flow of seawater around the hull. Further, since the conventional ballast water exchanger is constituted to deliver seawater through an inboard pipeline system to the ballast tank, resistance of the pipeline acts on the seawater. This may result in insufficient amount of exchanged and discharged water. It is therefore difficult to efficiently exchange the ballast water and also, it is difficult to achieve an adequate seawater exchange rate.

Further, a ship is not always navigated in a horizontally floating position on the sea, and the hull may be trimmed in a direction of a longitudinal axis of the hull in accordance with loading of cargo and ballast water. In general, since a ship loaded with ballast water has a shallow (low) draft and the engine of the ship is typically disposed in a rear part of the hull, the ship travels across the sea in a trim-by-the-stern state (a state in which the draft at the stern is deep) in many cases. In this case, a likely situation during the voyage is that it is difficult to carry out intake of seawater from a water intake opening disposed in a bulbous bow or in the vicinity thereof.

The present invention has been contrived in view of such circumstances. An object of the invention is to provide a ballast water exchanger and a ballast water exchange method for exchanging ballast water for seawater with a simple arrangement without depending on a forced circulation apparatus or any other powered apparatus, and increasing the ballast water/seawater exchange rate.

Another object of the invention is to provide a ship hull structure and a hull buoyancy control method capable of controlling hull buoyancy without depending on holding of ballast water in a ballast tank.

Means for Solving the Problems

To accomplish the above object, the present invention provides a ballast water exchanger for a ship with a ballast tank, comprising:

a partition provided in the ballast tank with an upper portion of the partition being open, and an inflow port and an outflow port which are open through a bottom of the ship;

wherein the partition forms a weir extending in a widthwise direction of a hull in the ballast tank, and divides a region in the ballast tank into an inflow area and an outflow area; and wherein the inflow port and the outflow port are disposed in the inflow area and the outflow area respectively and spaced apart from each other in a headway direction of the hull so that forward motion of the hull causes seawater outside the ship to flow into the ballast tank through the inflow port and the seawater in the ballast tank to flow out of the ship through the outflow port.

The present invention also provides a ballast water exchange method for exchanging ballast water in a ballast tank for seawater outside a ship during a voyage, comprising the steps of:

partitioning a region in the ballast tank into an inflow area and an outflow area by a weir extending in a widthwise direction of a hull, and providing an inflow port and an outflow port in positions, which are open through a bottom of the ship, in the inflow area and the outflow area, respectively;

wherein the seawater outside the ship is taken in the ballast tank through the inflow port and the seawater in the ballast tank is discharged from the ship through the outflow port, by means of difference in water pressure between the inflow port and the outflow port produced when the hull travels forward.

According to the aforementioned arrangement of the present invention, seawater outside the ship directly flows into the ballast tank through the bottom of the ship and the ballast water in the ballast tank directly flows out of the ship through the bottom of the ship. Since forward motion of the hull produces the difference in water pressure between the inflow port and the outflow port, fresh seawater always circulates in the ballast tank so far as the inflow port and the outflow port are kept open during the voyage. The seawater introduced into the ballast tank through the inflow port is redirected upward along the weir of the partition, and turning flow of the seawater around an axis extending in the widthwise direction of the hull (starboard-port direction) occurs in each of the inflow area and the outflow area. It is therefore unlikely that the ballast tank has a dead water zone, and the seawater exchange rate can be an adequately high value exceeding 90%. In the arrangement of the ballast water exchanger according to the present invention, the amount of seawater circulating in the ballast tank increases as the cruising time or distance increases. Therefore, the seawater exchange rate can be raised up to substantially 100% with increase of the cruising time or distance.

According to the ballast water exchanger and the ballast water exchange method of this invention, the ballast water can be automatically exchanged for seawater outside the ship by keeping the inflow port and the outflow port open during a voyage in ballast, without use of a complicated circulation system, cumbersome operation, chemicals and so forth. Therefore, use of ballast discharge means and so forth is merely required at a cargo loading point. Further, since the seawater used as the ballast water has the same conditions as those of the seawater in a current navigation area of the ship, environmental problems caused by transportation of marine life from a cargo unloading point to a cargo loading point can be surely overcome.

The present invention provides a fourth technique of ballast water exchange that is different from the conventional three methods as set forth above, namely, the sequential method, the flow-through method, and the dilution method. The aforementioned ballast tank, which is in communication with seawater outside the ship in accordance with the present invention, passively circulates the seawater, and therefore, the ballast tank can be considered to be a ballast-free hull structure. From such a viewpoint, the technological concept of the present invention can be defined as a ballast-free hull structure (or a ship ballast apparatus) or a hull buoyancy control method (or a ship ballast method) for reducing hull buoyancy during a voyage in an unloaded or lightly loaded condition, without depending on holding of the ballast water.

That is, the present invention provides a hull structure of a ship for reducing hull buoyancy during a voyage in an unloaded or lightly loaded condition, comprising:

a seawater circulating tank having an inflow port and an outflow port provided at a bottom of the ship, the inflow port and the outflow port being openable through the bottom of the ship;

wherein the inflow port is located forward of the outflow port in a headway direction of a hull, and the outflow port is located rearward of a inflow port in the headway direction of the hull, spaced apart from the inflow port by a predetermined distance; and wherein closure means is provided on the inflow port and the outflow port, the closure means opens the inflow port and the outflow port through the bottom of the ship during a voyage in an unloaded or lightly loaded condition so that difference in water pressure between the inflow port and the outflow port causes seawater outside the ship to circulate in the tank, and the closure means closes the inflow port and the outflow port during a voyage of the ship loaded with cargo, so that hull buoyancy is provided by means of air in the tank.

The present invention further provides a ballast-free hull buoyancy control method for reducing hull buoyancy during a voyage in an unloaded or lightly loaded condition of a ship, comprising the steps of:

using a seawater circulating tank provided with an inflow port and an outflow port located at a bottom of the ship, the inflow port and the outflow port spaced apart from each other by a predetermined distance in a headway direction of a hull;

opening the inflow port and the outflow port through the bottom of the ship during a voyage in the unloaded or lightly loaded condition so that difference in water pressure between the inflow port and the outflow port causes seawater outside the ship to circulate in the tank; and closing the inflow port and the outflow port by closure means during a voyage of the ship loaded with cargo so that the hull buoyancy is provided by air in the tank.

Preferably, the seawater circulating tank is partitioned into an inflow area and an outflow area by a weir extending in a widthwise direction of the hull.

According to the arrangement of the invention as set forth above, the air in the tank provides hull buoyancy during a voyage of the ship loaded with cargo, whereas seawater outside the ship always circulates in the tank in the unloaded or lightly loaded condition so that the hull buoyancy is reduced during the voyage of the ship. That is, the hull buoyancy is controlled by opening and closing operation of the closure means. Such an arrangement allows the hull buoyancy to be controlled without depending on holding of ballast water in the ballast tank.

EFFECT OF THE INVENTION

According to the ballast water exchanger and the ballast water exchange method of this invention, ballast water can be exchanged for seawater with a simple arrangement without depending on a powered apparatus for forced circulation, and a high ballast water/seawater exchange rate can be achieved.

According to the hull structure and the hull buoyancy control method of the present invention, the hull buoyancy can be controlled without depending on holding of the ballast water in the ballast tank.

EXPLANATION OF REFERENCE NUMERALS

Figure 1:
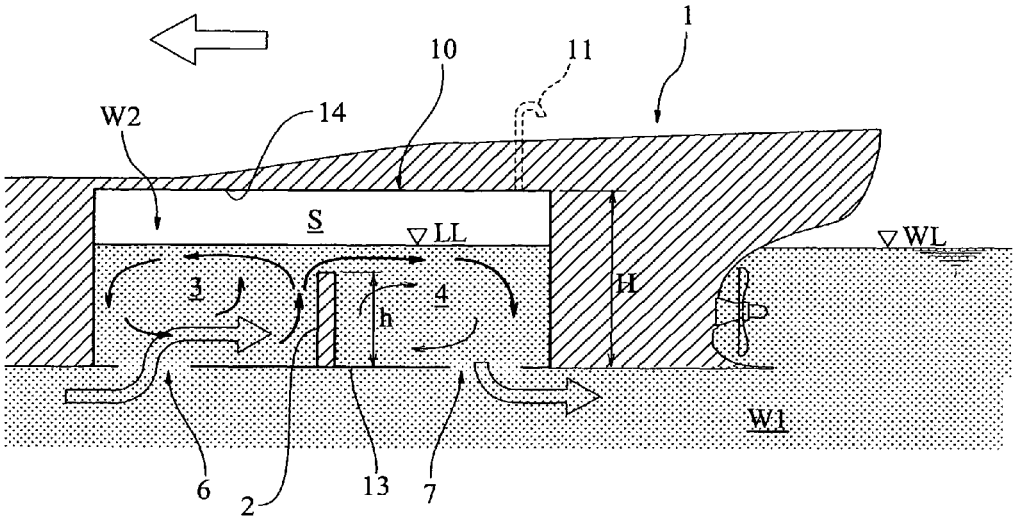
FIG. 1 is a partial longitudinal cross-sectional view showing an example of a ship with a ballast water exchanger according to the present invention.

1: ship
2: partition (weir)
3: inflow area (forward area)
4: outflow area (rearward area)
6: inflow port
7: outflow port
8: bilge portion
9: closure means
10: ballast tank
13: bottom of ship
W1: seawater
W2: ballast water
LL: water surface in a tank
WL: sea surface level

BEST MODE FOR CARRYING OUT THE INVENTION

According to a preferred embodiment of the invention, the inflow port is disposed in a center part in the widthwise direction of the bottom of the ship, and the outflow ports are disposed at right and left bilge portions. Since a relatively low water pressure acts on the right and left bilge portions compared to the center part of the bottom of the ship, the pressure difference between the inflow port and the outflow port for creating a fluid circulation in the ballast tank is reliably obtained.

The inflow port preferably includes a pivotable outer lid which directs an inflow opening forward of the hull. The outer lid constitutes the closure means. In a variation of the inflow port, the bottom of the ship may be provided with a streamlined recess, in which the inflow port is positioned. The opening of the inflow port is horizontally disposed in the recess or oriented forward of the hull. When such a structure of the inflow port is employed, an opening/closing device such as a slidable door (the closure means) is provided on the inflow port.

Each of the outflow ports preferably includes a pivotable outer lid which directs an outflow opening rearward of the hull. The outer lid constitutes the closure means. In a variation of the outflow port, the bottom of the ship may be provided with a streamlined downward bulge, and the outflow port may be positioned on the bulge protruding from the bottom of the ship. The opening of the outflow port is horizontally disposed on the bulge or oriented rearward of the hull. In another variation of the outflow port, a streamlined recess may be provided on the bottom of the ship in front of the outflow port, in consideration of an operation of the ship entering a dock when the ship undergoes inspection and maintenance. When the structures of the outflow ports according the variations are employed, an opening/closing device such as a slidable door (the closure means) is provided on the outflow port.

In another preferred embodiment of the invention, the distance (L1) between a front wall surface of the ballast tank and the partition is set to a value equal to or less than one-third of the overall length (L) of the ballast tank in the longitudinal direction of the hull. It is preferable that the inflow port is disposed in a position adjacent to the front wall surface of the ballast tank and the outflow port is disposed in a position adjacent to a rear wall surface of the ballast tank or adjacent to the rear surface of the partition (the surface on the rear side of the hull).

Preferably, the structure and dimensions of each component constituting the ballast water exchanger of the invention are so set as to exchange the ballast water in the ballast tank with seawater at a seawater exchange rate of 95% or higher within a cruising time of 30 minutes or a cruising distance of 10 km.

EXAMPLE

Figure 2:
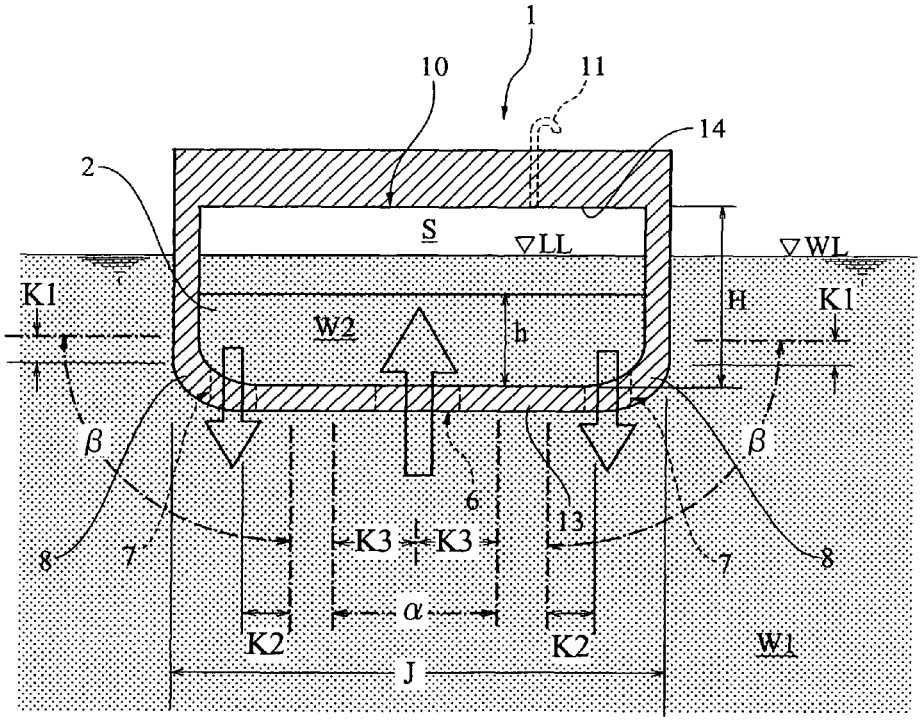
FIG. 2 is a lateral cross-sectional view of the ship shown in FIG. 1.

Preferred examples of the invention will be described below in detail with reference to the accompanying drawings. FIG. 1 is a partial longitudinal cross-sectional view illustrating an example of a ship with a ballast water exchanger according to the present invention. FIG. 2 is a lateral cross-sectional view of the ship shown in FIG. 1.

A ship 1 is provided with a ballast tank 10 having a partition 2 therein. The height h of the partition 2 is lower than a water surface LL in the tank when the ship is in a lightly loaded or unloaded condition. The partition 2 extends in the widthwise direction of the hull (in the starboard-port direction). The upper end of the partition 2 is spaced apart from a top wall surface 14 by a predetermined distance. The height h is preferably set to be equal to or greater than H×0.2, where H represents the overall height of the ballast tank 10.

Since the water pressure in the tank is in balance with the water pressure outside the ship, the level of the water surface LL (free surface) in the tank is substantially the same as the level of the draft line of the ship (sea surface level WL). The top wall surface 14 is located above the water surface LL in the tank so that a space S is formed between the water surface LL in the tank and the top wall surface 14. The ship 1 further includes an overflow tube (or an air vent tube) 11 through which the space S can be in communication with the atmosphere when the tank is charged with water. The overflow tube 11 opens to the space S on the top wall surface 14.

In the ballast tank 10, the partition 2 forms a weir, which partitions the region in the ballast tank 10 into an inflow area 3 and an outflow area 4. The areas 3 and 4 are in communication with each other over the partition 2. The inflow area 3, which is located on a front side as seen in a headway direction of the ship 1, has an inflow port 6 for taking seawater W1 in the ballast tank 10. The inflow port 6 is open through a bottom of the ship 13 under the sea surface (sea surface level WL). The outflow area 4, which is located on a rear side as seen in the headway direction of the ship 1, has an outflow port 7 for discharging seawater W2 from the ballast tank 10, and the outflow port 7 is open through the bottom of the ship 13 under the sea surface (sea surface level WL).

The inflow port 6 is preferably disposed in a center part of the bottom of the ship as seen in the widthwise direction, and the outflow port 7 is preferably disposed at right and left bilge portions 8, as shown in FIG. 2. Each of the inflow port 6 and the outflow ports 7 is provided with closure means (not shown) which can be opened and closed. Forward motion of the hull produces difference in water pressure between the inflow port 6 and the outflow ports 7, and the pressure difference causes the seawater W1 outside the ship to flow through the inflow port 6 to the outflow ports 7.

In general, the "bilge portion" means a curved portion on a side of the bottom of the ship and the vicinity of the curved portion. The bilge portion 8 herein, however, means a zone β (including the curved portion) which extends not only upward from the curved portion by a dimension K1 but also toward a keel from the curved portion by a dimension K2, each of the dimensions K1 and K2 (excluding the curved portion) being approximately one-tenth of the width of the ship J. The center part of the bottom of the ship in the widthwise direction means a zone α that extends toward both the starboard and port sides from a keel line at the center of the hull by a dimension K3, which is approximately one-fourth of the width of the ship J.

Figure 3:
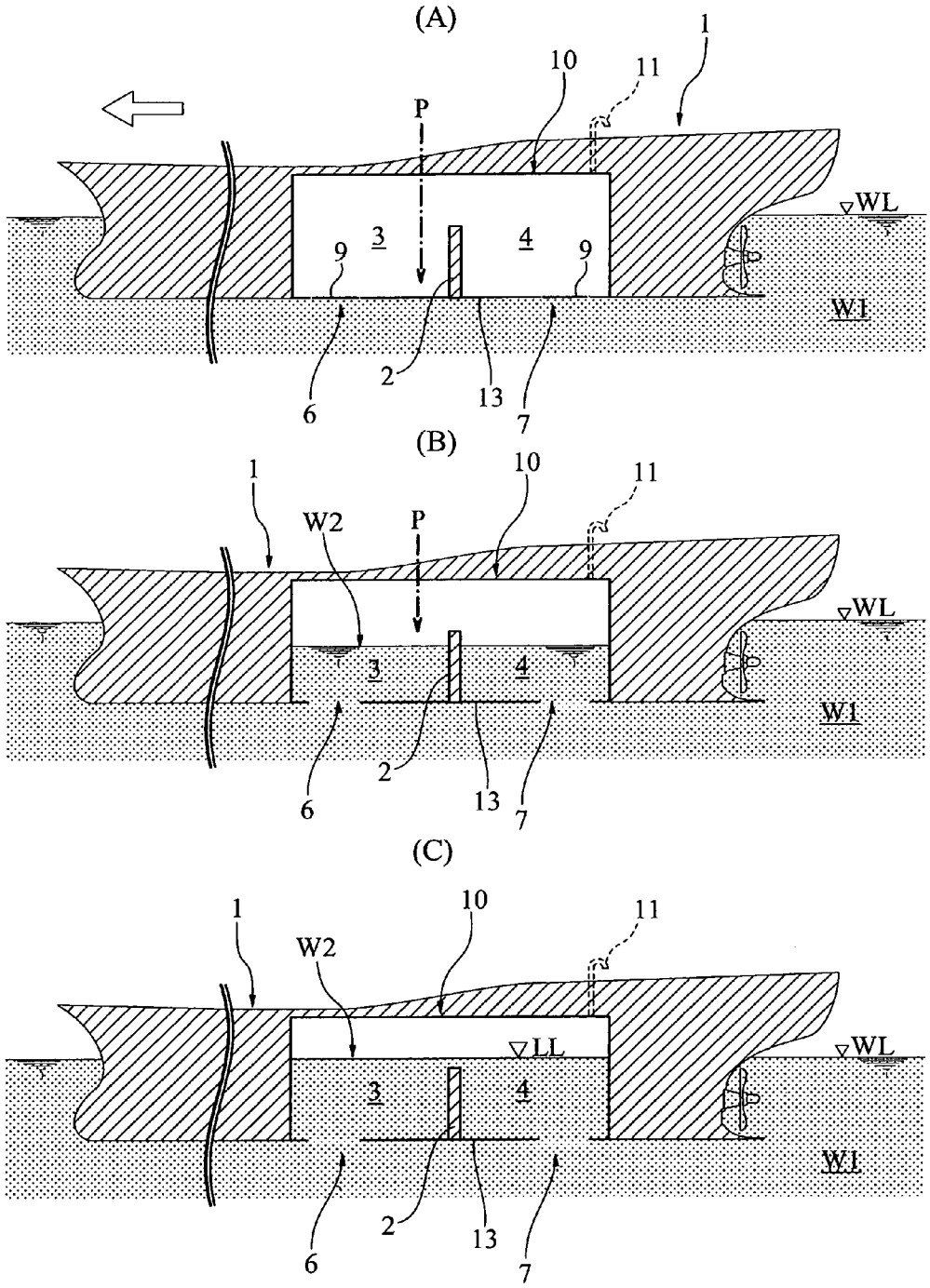
FIG. 3 is a longitudinal cross-sectional view schematically showing a condition of the ship as shown in FIGS. 1 and 2, the ship traveling on a route from a port of cargo loading to a port of cargo unloading.
Figure 4:
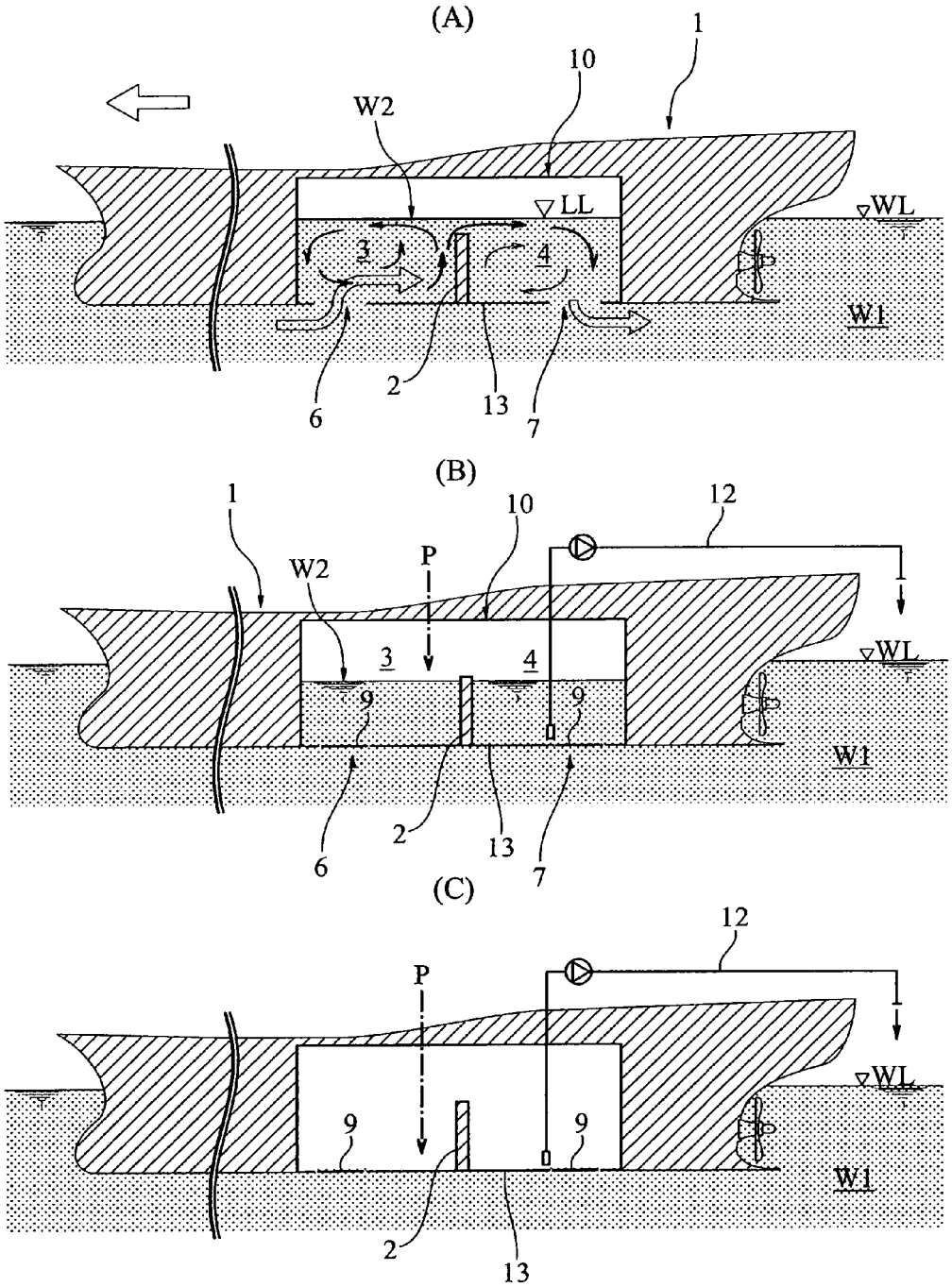
FIG. 4 is a longitudinal cross-sectional view schematically showing a condition of the ship as shown in FIGS. 1 and 2, the ship traveling on a route from the port of cargo unloading to the port of cargo loading.

FIGS. 3 and 4 are longitudinal cross-sectional views schematically showing how the ship 1 travels.

FIG. 3(A) illustrates how the ship 1 travels when cargo is loaded on the ship 1 or the ship 1 is fully loaded. FIG. 3(B) shows the state of the ship 1 when cargo is unloaded. FIG. 3(C) shows the state of the ship 1 after the ballast tank is charged with water.

As shown in FIG. 3(A), the ship 1 loaded with cargo or a ship 1 in a fully loaded condition travels across the sea in a state that the inflow port 6 and the outflow ports 7 are closed by the closure means 9 and that the ballast water has been discharged from the ballast tank 10. The ship 1, which has increased buoyancy owing to discharge of the ballast water, is subjected to a load P of the loaded cargo, and therefore, an adequate draft is ensured. The ship 1 thus keeps its stable attitude during its voyage.

When the ship 1 reaches a port of cargo unloading and the cargo is unloaded, the load P decreases to cause excess buoyancy, whereby the attitude of the ship becomes unstable. The closure means 9 and the overflow tube 11 are opened, and the difference between the water level in the tank and the seawater level outside the ship causes seawater outside the ship to automatically flow into the tank through the inflow port 6 and the outflow ports 7 at the bottom of the ship. Therefore, the ballast tank 10 is charged with water substantially at the same time as the cargo is unloaded. As shown in FIG. 3(B), the water level in the tank is elevated up to a level (water surface LL in the tank) that is substantially the same as the draft (sea surface level WL), so that a desired draft is obtained.

FIG. 4(A) illustrates how the ship travels in a lightly loaded or unloaded condition.

As shown in FIG. 4(A), the ship 1 in a lightly loaded or unloaded condition departs from the cargo unloading point and travels across the sea with the closure means 9 kept open. The seawater W1 flows through the inflow port 6 into the inflow area 3, and moves to the outflow area 4 over the weir of the partition 2, and then, flows out of the ship through the outflow ports 7, as indicated by the arrows in FIG. 4(A). Zooplankton, phytoplankton, and other organisms which have entered the ballast tank 10 along with the ballast water at the cargo unloading port are discharged out of the ship into the waters at the cargo unloading port or the vicinity thereof. Appropriate setting of the positions, structures, configurations, and dimensions of the partition 2, the inflow port 6, and the outflow ports 7 allows the seawater W2 in the ballast tank 10 to be normally kept in the same conditions as the seawater W1 outside the ship with use of the headway speed of the ship 1. Also, such setting prevents a dead water region from being formed in the ballast tank 10, and allows all the water in the ballast tank 10 to be always exchanged with fresh seawater W1 while the ship 1 travels.

FIG. 4(B) shows how the ship 1 moored at a cargo loading port discharges the ballast water, and FIG. 4(C) shows the state of the ship 1 after the ballast water is discharged.

The ship 1, after reaching a cargo loading port, is loaded with new cargo. In order to provide desired buoyancy corresponding to increase in cargo load P, the closure means 9 closes the inflow port 6 and the outflow ports 7 as shown in FIG. 4(B), and the seawater W2 in the ballast tank 10 is discharged out of the ship as shown in FIG. 4(C). Discharge of water is carried out by a discharge system 12, which includes a discharge pump, a discharge pipe and so forth.

In the conventional system, ballast water discharged at a cargo loading port through a ballast water discharge process has been seawater transported from a cargo unloading port to the cargo loading port, and microorganisms, bacteria, and other marine life in the waters at the cargo unloading port may affect the ecosystem in the waters at the cargo loading port in some cases. Such discharge of ballast water has therefore been regarded as a problem particularly in recent years. In the present invention, the seawater W2 discharged out of the ship 1 is, however, seawater taken from waters immediately before the ship 1 reaches the cargo loading port, for example, the waters at the cargo loading port or adjacent waters thereof. Therefore, the discharged ballast water does not affect the ecosystem in the waters at the cargo loading port.

Figure 17:
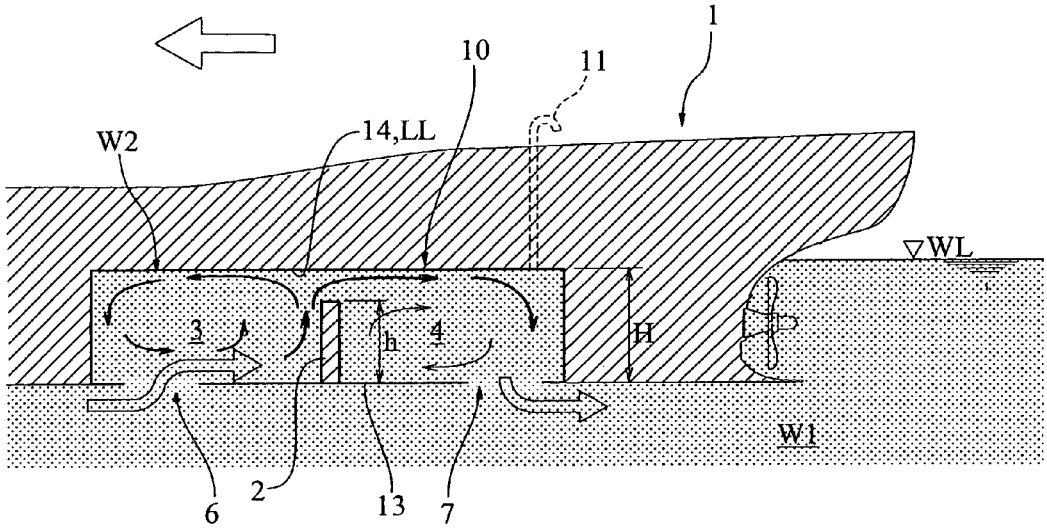
FIG. 17 is a partial longitudinal cross-sectional view of a ship showing a modification of the ballast water exchanger shown in FIGS. 1 to 4.
Figure 18:
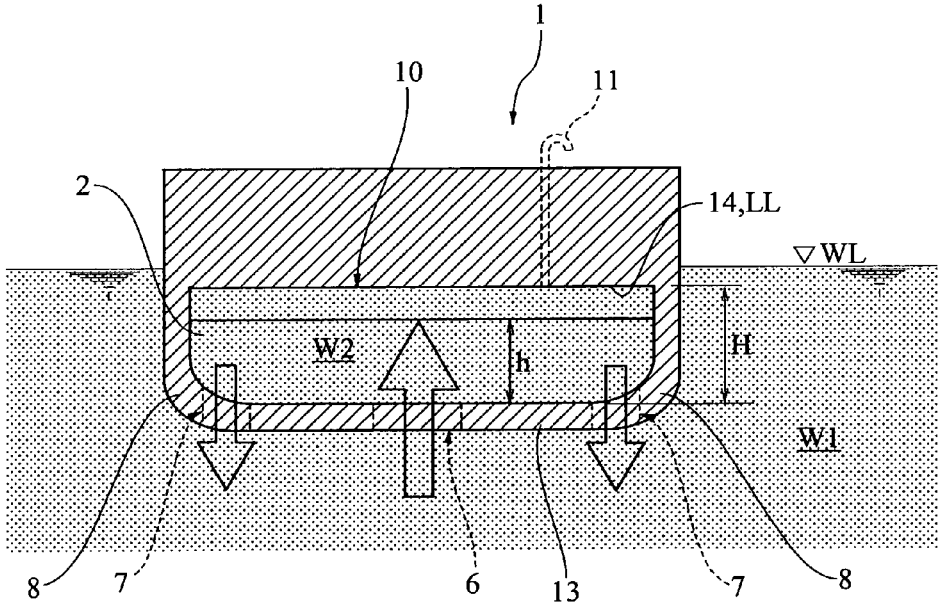
FIG. 18 is a lateral cross-sectional view of the ship shown in FIG. 17.

FIGS. 17 and 18 are a partial longitudinal cross-sectional view and a lateral cross-sectional view of a ship, respectively, and show a variation of the ballast water exchanger shown in FIGS. 1 to 4. In the ballast water exchanger shown in FIG. 1, the level of the water surface LL in the tank is substantially the same as the draft of the ship (sea surface level WL) and the top wall surface 14 is located above the water surface LL in the tank. On the other hand, in the ballast water exchanger shown in FIGS. 17 and 18, the top wall surface 14 is located below the draft (sea surface level WL) and the water surface LL in the tank coincides with the top wall surface 14. Specifically, the ballast tank 10 configured to form a free surface (water surface LL) of the ballast water in the tank as shown in FIGS. 1 to 4 advantageously ensures a large amount of ballast or enables variable setting of the amount of ballast. On the other hand, the ballast tank 10 configured to be filled with seawater to the ceiling thereof shown in FIGS. 17 and 18 can not only prevent violent behavior of the ballast water in the tank during the voyage but also improve the stability of the hull. This is because no free surface is formed in the tank.

Figure 19:
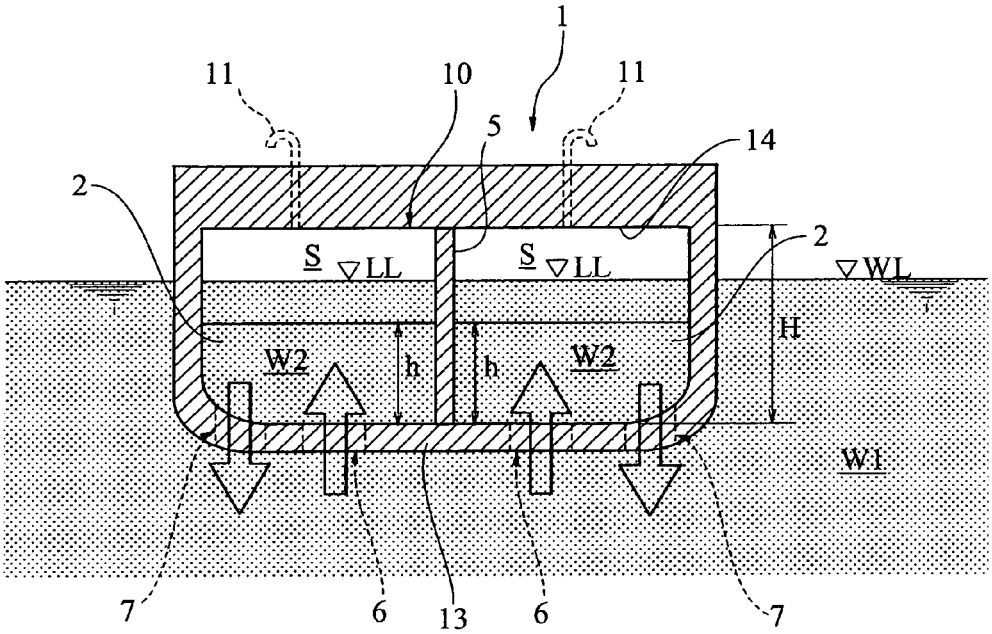
FIG. 19 is a lateral cross-sectional view of a ship which shows another modification of the ballast water exchanger shown in FIGS. 1 to 4.

FIG. 19 is a lateral cross-sectional view of a ship and shows another variation of the ballast water exchanger shown in FIGS. 1 to 4. The ballast tank 10 is divided in its widthwise direction by a partition 5 extending in the longitudinal direction of the hull, as shown in FIG. 19. The inflow port 6 and the outflow port 7 are provided in each of the divided areas of the ballast tank 10. In such a configuration, the width of the free surface (water surface LL) in the ballast tank 10 decreases, and therefore, the stability of the hull is improved.

Figure 20:
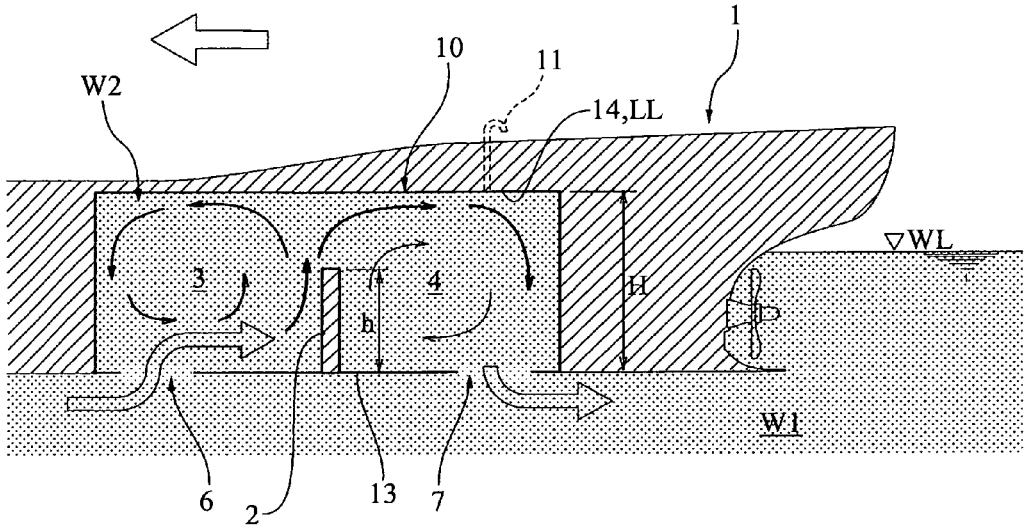
FIG. 20 is a partial longitudinal cross-sectional view of a ship which shows still another modification of the ballast water exchanger shown in FIGS. 1 to 4.
Figure 21:
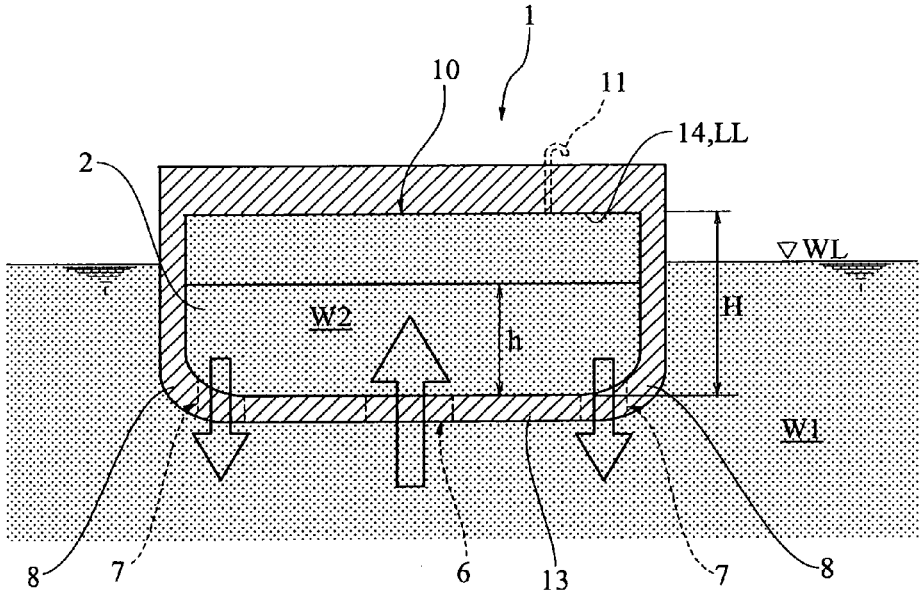
FIG. 21 is a lateral cross-sectional view of the ship as shown in FIG. 20.

FIGS. 20 and 21 are a partial longitudinal cross-sectional view and a lateral cross-sectional view of a ship, respectively. Still another variation of the ballast water exchanger shown in FIGS. 1 to 4 is illustrated in FIGS. 20 and 21.

In the ballast water exchanger shown in FIGS. 20 and 21, the top wall surface 14 is located above the draft (sea surface level WL) and the water surface LL in the tank coincides with the top wall surface 14. The ballast water exchanger includes seawater introducing means or seawater pumping means, such as a pump and a pipeline, in order to fill the ballast tank 10 with seawater to the ceiling. Such a construction of the ballast tank 10 enables a large amount of ballast water or variable setting of the amount of ballast water. Further, such a structure of tank can not only prevent violent behavior of the ballast water in the tank during the voyage but also improve the stability of the hull. Moreover, employment of such a structure of tank enables a compact design of the ballast tank 10 in a plan.

Figure 22:
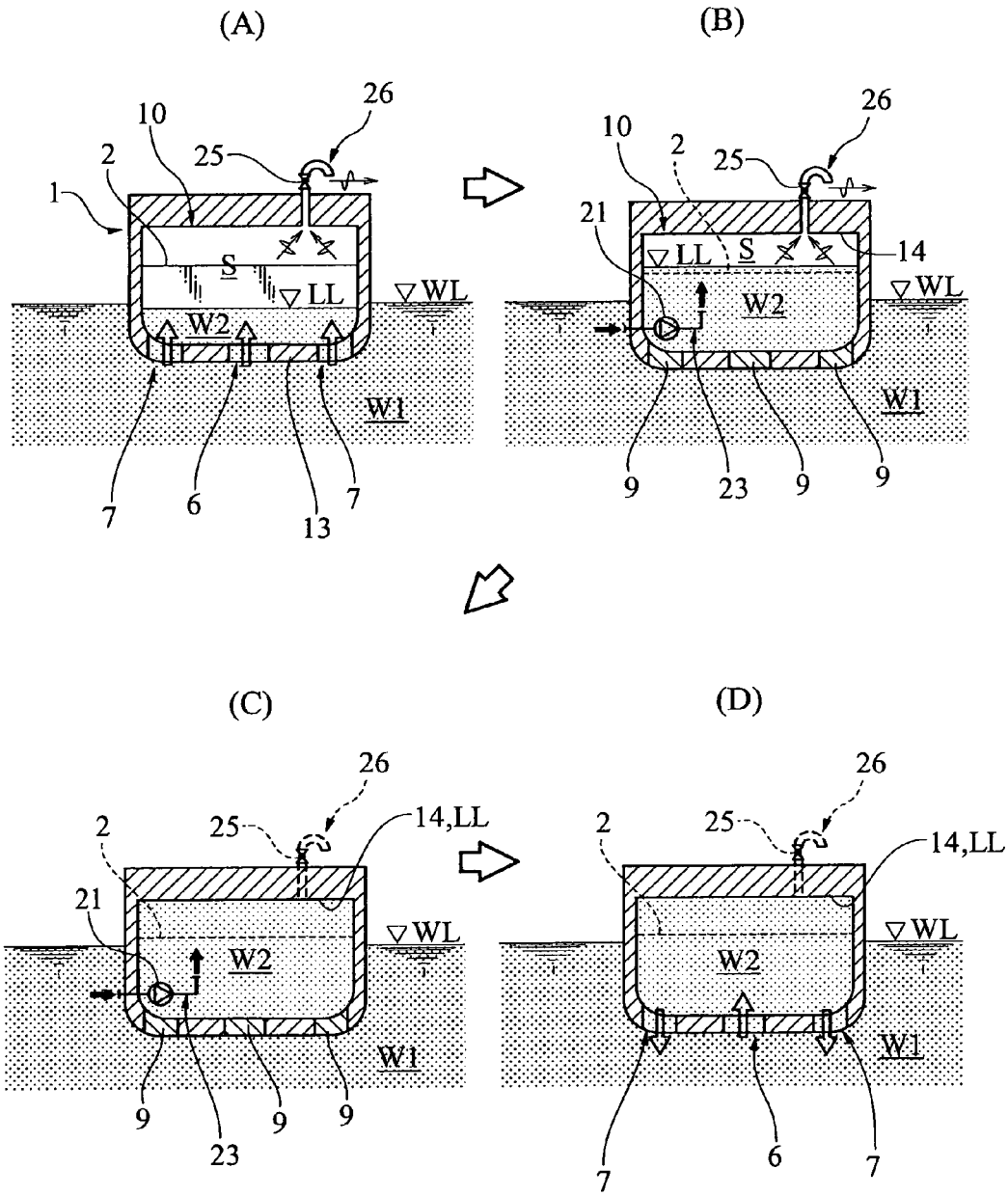
FIG. 22 is a cross-sectional view showing how to introduce the seawater into a ballast tank up to a level above the draft line.
Figure 23:
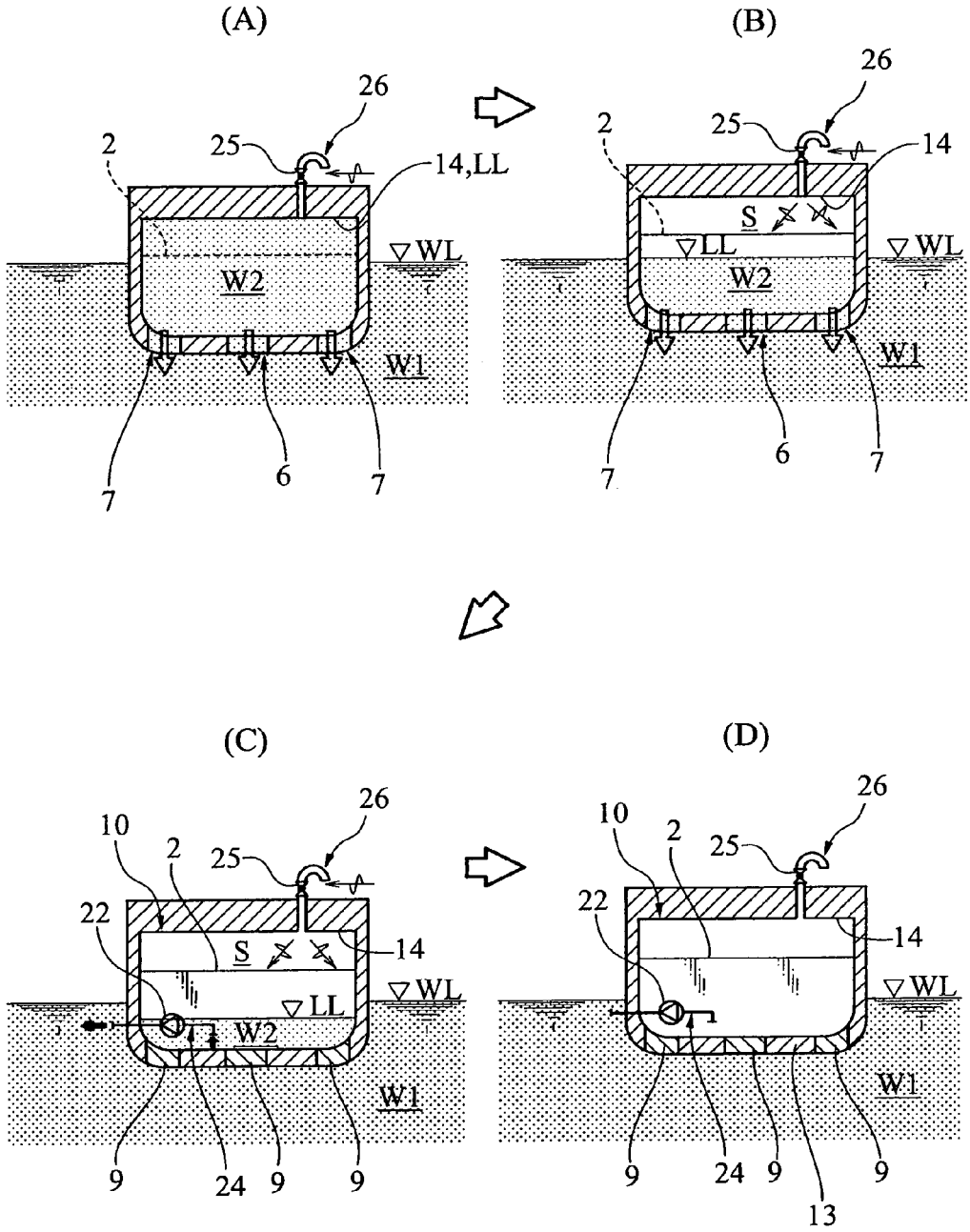
FIG. 23 is a cross-sectional view showing how to forcibly discharge the seawater from the ballast tank.

FIGS. 22 and 23 illustrate a method for elevating the water surface LL in the tank up to a level above the draft (sea surface level WL). FIG. 22 shows how to introduce the seawater W1 into the ballast tank 10, for example, at a cargo unloading port, and FIG. 23 shows how to cause the seawater W2 in the ballast tank 10 to flow out of the ship, for example, at a cargo loading port. The ship 1 includes pipelines 23 and 24 equipped with pumps 21 and 22 for pumping seawater in order to forcibly elevate the water surface LL in the tank. The ship 1 further includes a vent tube 26 equipped with a valve 25. The vent tube 26 also constitutes the seawater introducing means as set forth above. One end of the vent tube 26 is open at the top wall surface 14 to be in communication with the space S in the tank, and the other end thereof is open to the atmosphere. The overflow tube 11 as previously described may alternatively be used as the vent tube 26. A single common pressurizing/pumping apparatus may be used as the pumps 21 and 22. Further, the pipelines 23 and 24 may be designed as a single pipe system or a set of pipe systems.

FIG. 22(A) shows the ship 1 with the ballast tank 10, wherein the ballast water has been discharged from the tank 10. When the inflow port 6, the outflow ports 7, and the valve 25 are open, the seawater W1 outside the ship flows into the tank through the inflow port 6 and the outflow ports 7. The air in the tank is discharged through the vent tube 26 to the atmosphere. The water surface LL in the tank is elevated up to a level that is substantially the same as the draft of the ship (sea surface level WL). When the closure means 9 closes the inflow port 6 and the outflow ports 7 and the pump 21 on the seawater introducing pipeline 23 is operated, the seawater W1 is forced to flow into the ballast tank 10 as shown in FIG. 22(B), and the water surface LL in the tank is raised up to the level of the top wall surface 14 as shown in FIG. 22(C).

When the valve 25 is closed in this state, the inflow port 6 and the outflow ports 7 can be opened in a condition that the seawater W2 is held in the ballast tank 10, as shown in FIG. 22(D). Specifically, when the valve 25 is closed so that the interior of the tank is not in communication (ventilation) with the atmosphere, the ship 1 can travel with the inflow port 6 and the outflow ports 7 being open. In this state, the seawater W1 outside the ship flows into the ballast tank 10 through the inflow port 6, circulates in the ballast tank 10, and flows out of the ship through the outflow ports 7 in accordance with the forward motion of the ship 1.

FIG. 23(A) shows the ship 1 with the ballast tank 10 filled with seawater W2 to the top wall surface 14. As the inflow port 6, the outflow ports 7, and the valve 25 are opened in this state, the seawater W1 flows out of the tank through the inflow port 6 and the outflow ports 7. The air outside the ship enters the tank through the vent tube 26. The water surface LL in the tank is lowered down to a level that is substantially the same as the draft of the ship (sea surface level WL), as shown in FIG. 23(B). When the closure means 9 closes the inflow port 6 and the outflow ports 7 and the pump 22 on the seawater introducing pipeline 24 is activated, the seawater W2 in the tank can be forcibly discharged from the ship as shown in FIG. 23(C). The water surface LL in the tank is lowered down to the level of the bottom of the ship 13 or the vicinity thereof as shown in FIG. 23(D).

Figure 5:
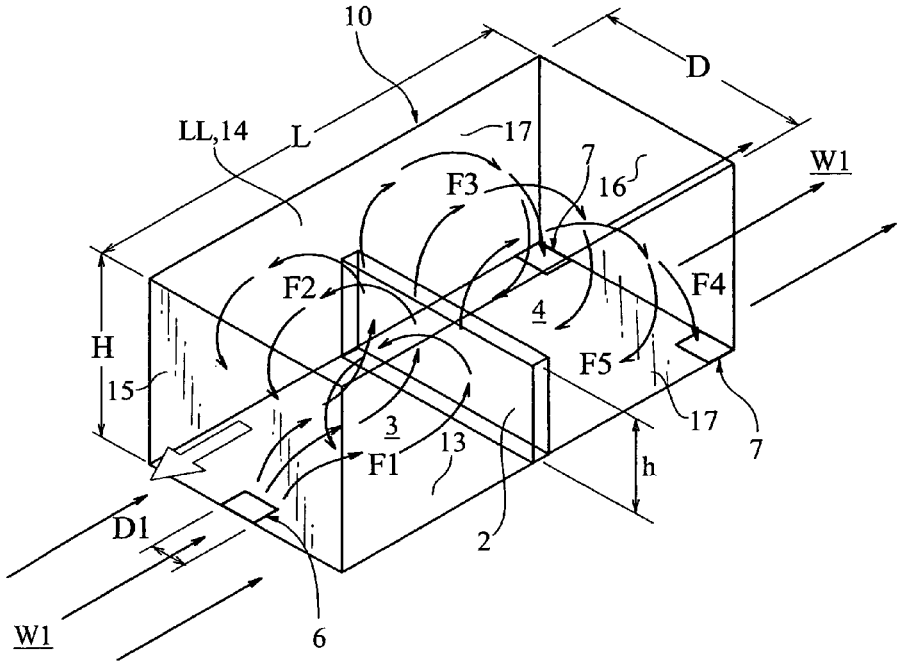
FIG. 5 is a perspective view schematically showing the structure of a ballast tank.
Figure 6:
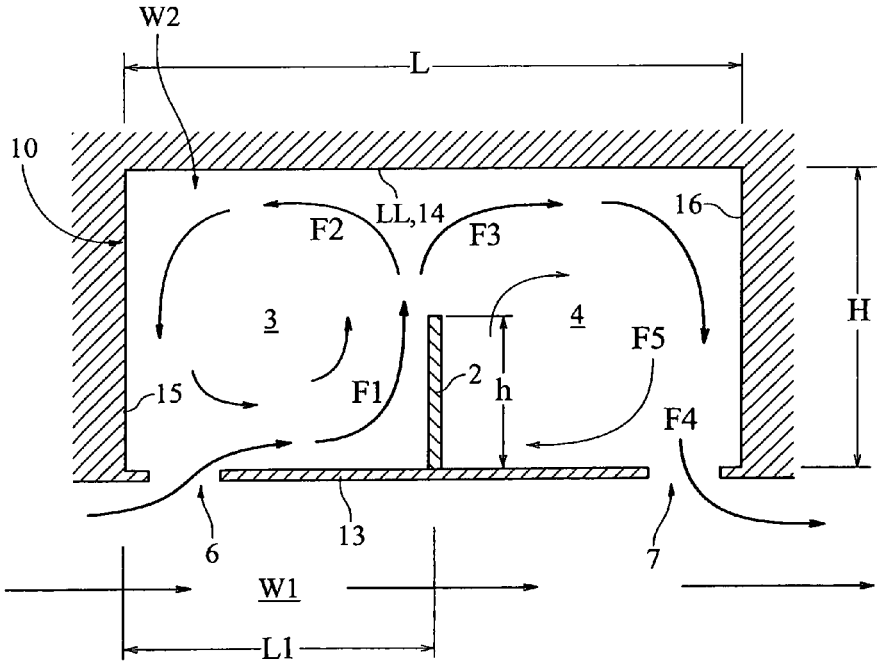
FIG. 6 is a longitudinal cross-sectional view schematically showing the structure of the ballast tank.
Figure 7:
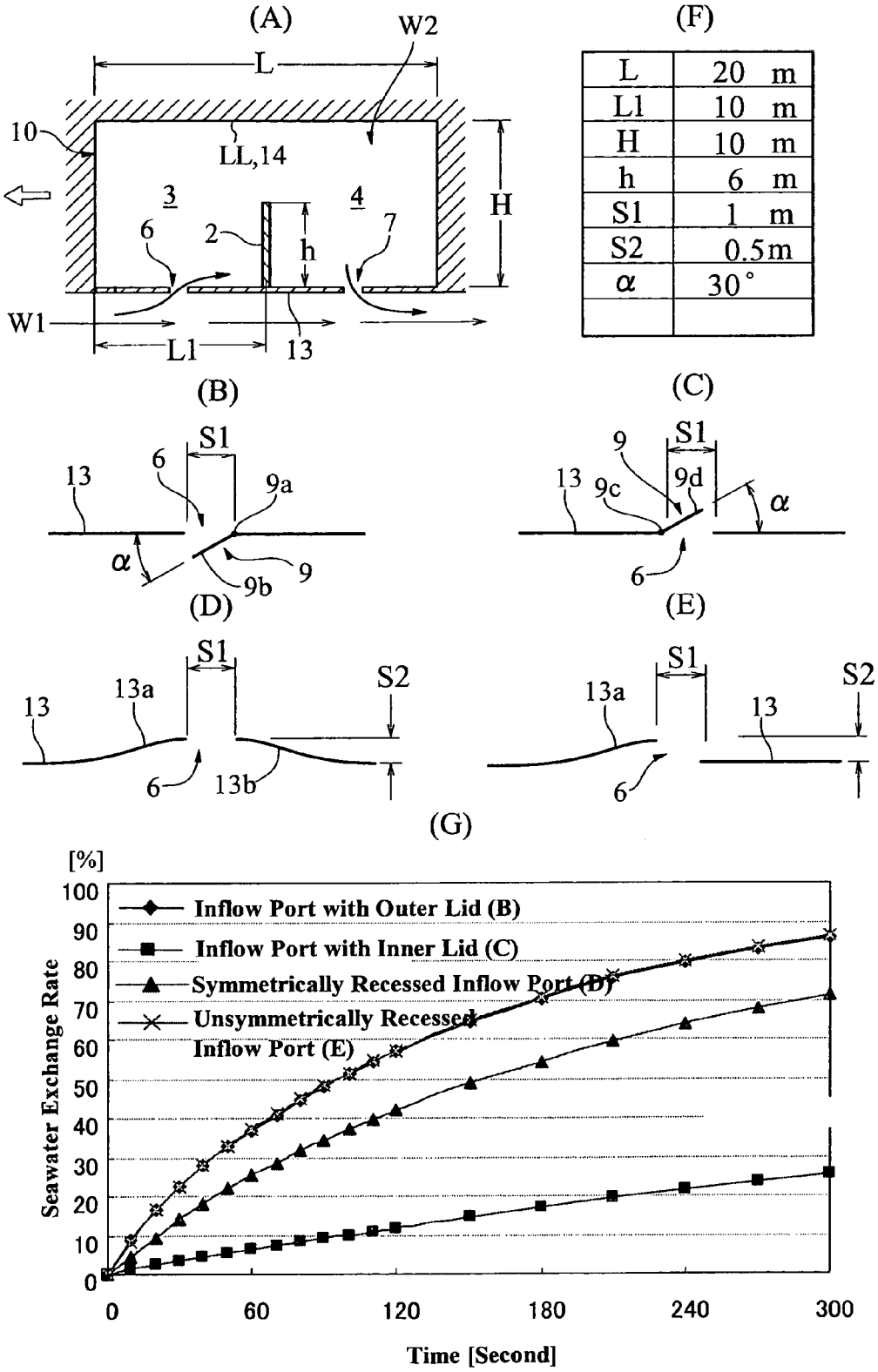
FIG. 7 includes a schematic longitudinal cross-sectional view, a table, and a diagram showing the relationship between the configuration and structure of an inflow port and a seawater exchange rate.
Figure 8:
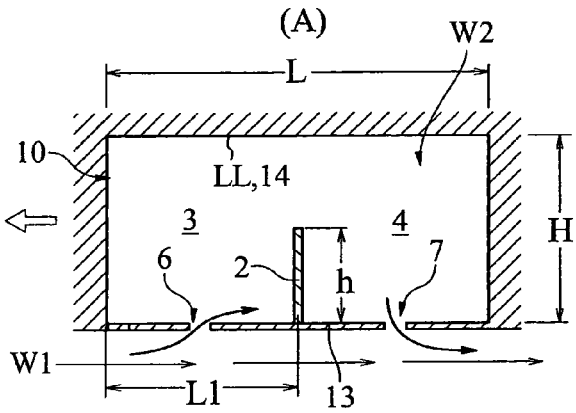
FIG. 8 includes a schematic longitudinal cross-sectional view, a table, and a diagram showing the relationship between the configuration and structure of an outflow port and the seawater exchange rate.
Figure 8:
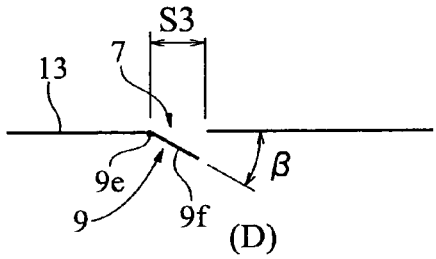
Figure 8:
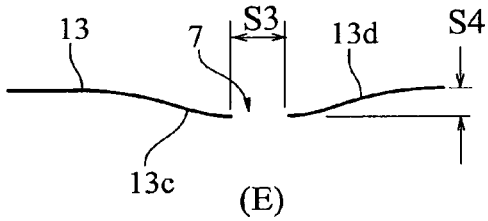
Figure 8:
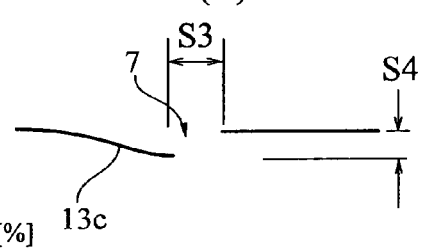
Figure 8:
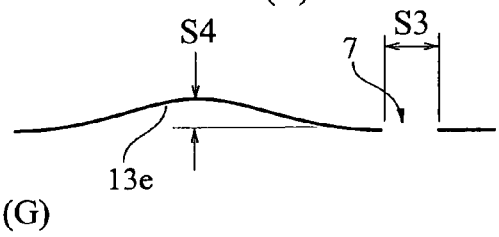
Figure 8:
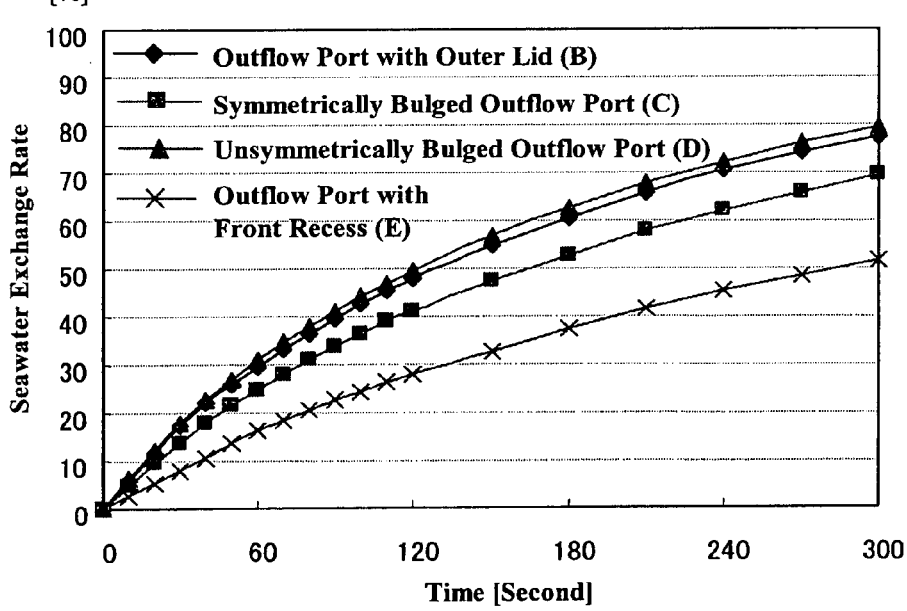

FIGS. 5 and 6 are a perspective view and a longitudinal cross-sectional view, which schematically illustrate the structure of the ballast tank 10 shown in FIGS. 1 to 4. FIG. 7 includes a schematic longitudinal cross-sectional view, a table, and a diagram showing the relationship between the configuration and structure of the inflow port 6 and the seawater exchange rate. FIG. 8 includes a schematic longitudinal cross-sectional view, a table, and a diagram showing the relationship between the configuration and structure of the outflow port 7 and the seawater exchange rate.

As shown in FIGS. 5 and 6, the seawater W1 outside the ship is introduced through the inflow port 6 into the ballast tank 10 along the upper surface of the bottom of the ship 13, and it is redirected upward along the front surface of the partition 2 as indicated by the flow F1, and then, it branches in the vicinity of the upper end of the partition 2 into a reverse flow F2 and a successive flow F3. The reverse flow F2 moves forward of the hull along the free surface LL in the inflow area 3 or the top wall surface 14, descends along a front wall surface 15 of the inflow area 3, and then, moves toward the partition 2 along with the flow F 1 of the seawater flowing through the inflow port 6. On the other hand, the successive flow F3 flows over the partition 2 into the outflow area 4. The successive flow F3 moves rearward of the hull along the free surface LL in the outflow area 4 or the top wall surface 14, and descends along a rear wall surface 16 of the outflow area 4. Most of the seawater flows out of the ship through the outflow ports 7 as indicated by the flow F4, whereas the remainder of the seawater is deflected toward the partition 2 forward of the hull as indicated by the flow F5. The flow F5 moves forward over the bottom of the ship 13, and it is deflected upward along the rear surface of the partition 2, and then, it flows into the outflow area 4 along with the successive flow F3. Therefore, turning flows circulating in opposites directions around axes extending in the widthwise direction (starboard-port direction) are created in the inflow area 3 and the outflow area 4, so as not to provide a dead water zone in the ballast tank 10.

The ballast tank 10 shown in FIGS. 5 and 6 has a rectangular prism form of H in height, L in total length, and D in width. The partition 2 extends in the widthwise direction of the hull and is spaced apart from the front wall surface 15 by a distance L1. The partition 2 is a flat plate of h in height and stands in an upright position on the bottom of the ship 13. A flat-plate partition, which has a stiffener or any other suitable reinforcing frame attached to the flat plate, can be used as the partition 2. When the reinforcing frame is exposed in the tank, the reinforcing frame is desirably positioned on the backside of the flat plate in consideration of the flow of the fluid in the tank.

As described above, the inflow port 6 of D1 in width is preferably disposed in the vicinity of the front wall surface 15 and in a center part of the bottom of the ship (at a widthwise center of the ballast tank 10 in the present example). The outflow ports 7 are disposed in the vicinity of the rear wall surface 16 and adjacent to right and left sidewall surfaces 17 of the ballast tank 10. As described above, the outflow ports 7 are preferably disposed at the bilge portions 8 (FIG. 2) of the hull.

FIG. 7 shows the relationship between the structure and configuration of the inflow port 6 and the seawater exchange rate. FIG. 7(A) shows a cross-section of the ballast tank 10 used in two-dimensional fluid analysis. Each of FIGS. 7(B) to 7(E) shows the structure and configuration of the inflow port 6 used in the two-dimensional fluid analysis. FIG. 7(F) shows dimensions and an angle set in the two-dimensional fluid analysis.

The intake port 6 shown in FIG. 7(B) has an outer lid 9*b* pivotable about a pivot axis 9*a*, and the inflow port 6 shown in FIG. 7(C) has an inner lid 9*d* pivotable about a pivot axis 9*c*. The pivot axes 9*a*, 9*c*, the outer lid 9*b*, and the inner lid 9*d* not only constitute the closure means 9 but also constitute guide means for guiding the seawater W1 outside the ship into the inflow area 3. The inflow port 6 shown in FIG. 7(D) has front and rear inclined walls 13*a*, 13*b* which form a streamlined recess at the bottom of the ship. The inflow port 6 is a horizontal opening formed in a portion recessed from the bottom of the ship. The inflow port 6 shown in FIG. 7(E) has a front inclined wall 13*a* which forms a streamlined recess at the bottom of the ship. The inflow port 6 is an opening directed slantingly downward and forward. Each of the inflow ports 6 shown in FIGS. 7(D) and 7(E) includes a slidable door (not shown) which constitutes the closure means 9.

FIG. 7(G) shows changes with time in the seawater exchange rate obtained by the two-dimensional fluid analysis when the headway speed of the ship is set to be 15 knots. The seawater exchange rate is an index indicative of the proportion of the seawater W2 in the ballast tank 10 replaced with the seawater W1 outside the ship, which is obtained on the basis of change in concentration of the seawater W2.

The outer-lid-type inflow port 6 with the outer lid 9*b* (FIG. 7(B)) and the asymmetric recess-type inflow port 6 with the front inclined wall 13*a* (FIG. 7(E)) exhibit good seawater exchange rates. The symmetric recess-type inflow port 6 with the symmetric inclined walls 13*a* and 13*b* (FIG. 7(D)) also exhibits a relatively good seawater exchange rate. The inner-lid-type inflow port 6 with the inner lid 9*d* (FIG. 7(C)) exhibits a lower seawater exchange rate.

FIG. 8 shows the relationship between the structure and configuration of the outflow port 7 and the seawater exchange rate. FIG. 8(A) shows a cross-section of the ballast tank 10 used in the two-dimensional fluid analysis. Each of FIGS. 8(B) to 8(E) shows the structure and configuration of the outflow port 7 used in the two-dimensional fluid analysis. FIG. 8(F) shows dimensions and an angle set in the two-dimensional fluid analysis.

The outflow port 7 shown in FIG. 8(B) has an outer lid 9*f* pivotable about a pivot axis 9*e*. The pivot axis 9*e* and the outer lid 9*f* not only constitute the closure means 9 but also constitute guide means for guiding the seawater W2 in the ballast tank 10 out of the ship. The outflow port 7 shown in FIG. 8(C) has inclined walls 13*c* and 13*d* which form a streamlined bulge at the bottom of the ship, and the outflow port 7 is a horizontal opening in a portion downwardly bulging from the bottom of the ship. The outflow port 7 shown in FIG. 8(D) has a front inclined wall 13*c* which forms a streamlined bulge at the bottom of the ship, and the outflow port 7 is an opening directed slantingly downward and rearward. The outflow port 7 shown in FIG. 8(E) includes a streamlined recess 13*e* at the bottom of the ship in front of the outflow port 7. Each of the outflow ports 7 shown in FIGS. 8(C) to 8(E) includes a slidable door (not shown) which constitutes the closure means 9.

FIG. 8(G) shows change with time in the seawater exchange rate obtained by the two-dimensional fluid analysis when the headway speed is set to be 15 knots. The outer-lid-type outflow port 7 with the outer lid 9*f* (FIG. 8(B)) and the symmetric and asymmetric bulge-type outflow ports 7 (FIGS. 8(C) and 8(D)) exhibit good seawater exchange rates.

The front recess-type outflow port 7 with the recess 13*e* formed in front of the outflow port 7 (FIG. 8(E)) exhibits a slightly lower seawater exchange rate. However, since the structure of the front recess-type outflow port 7 does not have a section protruding outward from the hull, this structure is advantageous in a process of accommodating the ship in a dock when the ship undergoes inspection and maintenance.

Figure 9:
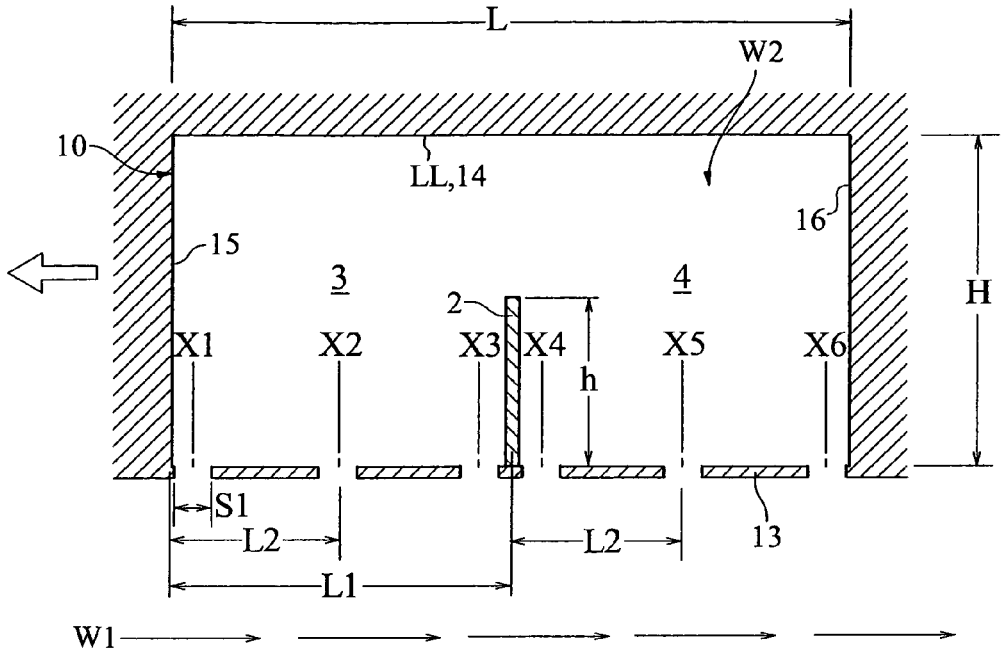
FIG. 9 includes a schematic longitudinal cross-sectional view and a table showing the relationship among a position of the inflow port, a position of the outflow port, presence or absence of a partition, and the seawater exchange rate.

FIG. 9 shows the relationship among the position of the inflow port 6, the position of the outflow port 7, the presence or absence of the partition 2 and the seawater exchange rate. FIG. 9(A) is a schematic cross-sectional view of the ballast tank 10 used in the two-dimensional fluid analysis. FIG. 9(B) is a table showing the seawater exchange rates obtained by the two-dimensional fluid analysis. The seawater exchange rates shown in FIG. 9(B) are those obtained after 300 seconds of navigation of the ship.

The partition 2 significantly improves the seawater exchange rate, as readily understood from comparison of the seawater exchange rates in a case where the partition 2 is provided (Cases 1 to 6) and the seawater exchange rates in a case where the partition 2 is not provided (Cases 7 to 12).

The seawater exchange rates in the configurations of the invention (Cases 1 to 3), in which the inflow port 6 is disposed in the inflow area (front area) 3 and the outflow port 7 is disposed in the outflow area (rear area) 4, are clearly higher than the seawater exchange rates in the configurations (Cases 4 to 6) in which the inflow port 6 is disposed in the rear area 4 and the outflow ports 7 are disposed in the front area 3.

Figure 10:
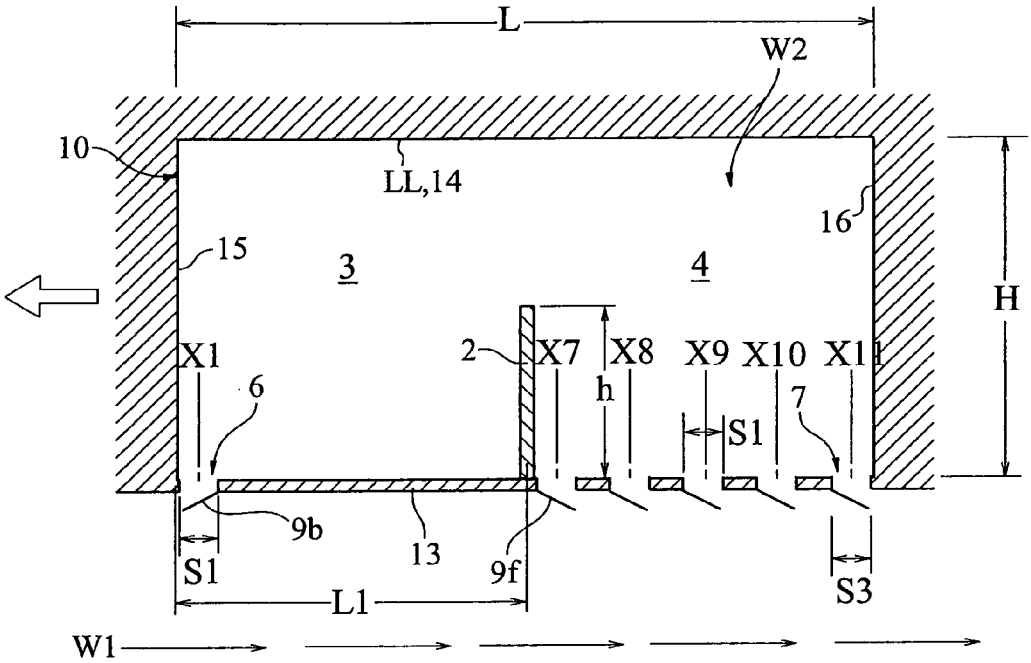
FIG. 10 is a schematic longitudinal cross-sectional view of the ballast tank which shows positions of the outflow ports.

FIG. 10 is a schematic longitudinal cross-sectional view of the ballast tank 10, which illustrates possible positions of the outflow ports 7.

The present inventor has conducted the two-dimensional fluid analysis under the condition that the outer-lid-type inflow port 6 is fixed in a position X1 (a position adjacent to the front wall surface 15) and that the outer-lid-type outflow port 7 is selectively located in any of positions X7-X11. When the outflow port 7 is disposed in the position X7 adjacent to the rear surface of the partition 2, or when the outflow port 7 is disposed in the position X11 adjacent to the rear wall surface 16, the seawater exchange rate obtained after 300 seconds of navigation of the ship exceeds 90%. When the outflow port 7 is positioned at any of X8, X9, and X10 between the positions X7 and X11, the seawater exchange rate obtained after 300 seconds of navigation of the ship decreases and falls within a range from 85 to 90%.

Figure 11:
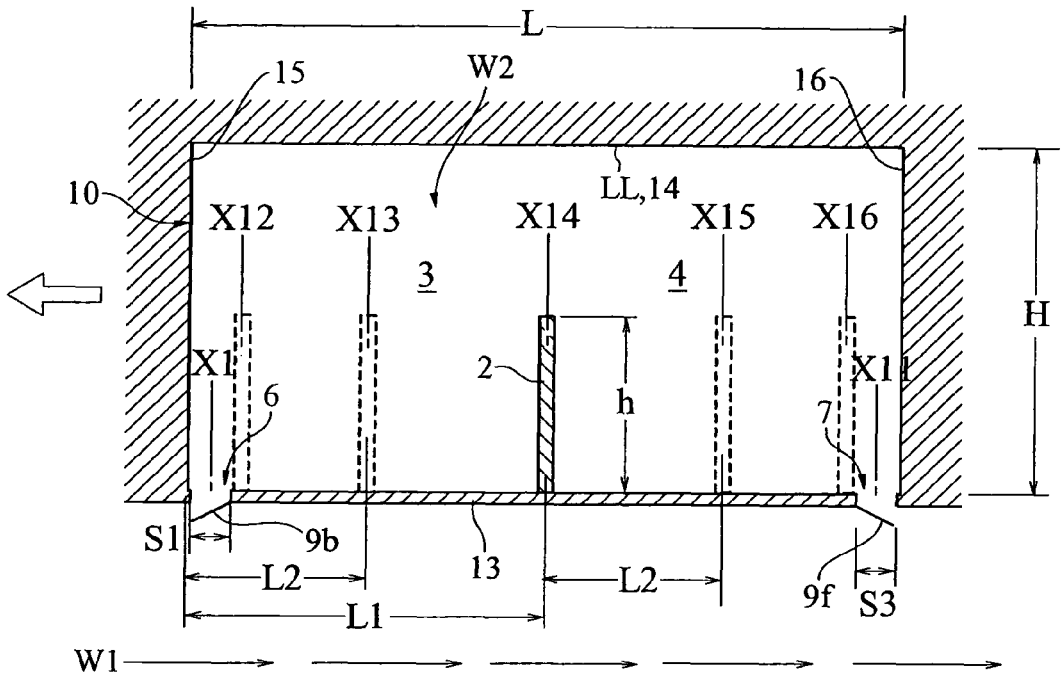
FIG. 11 is a schematic longitudinal cross-sectional view of the ballast tank which shows positions of the partition.

FIG. 11 is a schematic cross-sectional view of the ballast tank 10, in which possible positions of the partition 2 are illustrated.

The present inventor has conducted the two-dimensional fluid analysis under the condition that the outer-lid-type inflow port 6 is fixed in the position X1, that the outer-lid-type outflow port 7 is fixed in the position X11, and that the partition 2 is selectively located in any of positions X12-X16. When the partition 2 is positioned at any of X13, X14, and X15, the seawater exchange rate obtained after 300 seconds of navigation of the ship exceeds 90%. When the partition 2 is positioned at X12 or X16, the seawater exchange rate obtained after 300 seconds of navigation of the ship decreases and falls within a range from 85 to 90%.

According to the results of the two-dimensional fluid analysis as described above, the outflow ports 7 are desirably located in the position X7 adjacent to the rear surface of the partition 2 or the position X11 adjacent to the rear wall surface 16, and the partition 2 is desirably located at any of the positions X13, X14, and X15. It is considered desirable to locate the partition 2 in the position (X13) slightly away from the central position (X14) in the forward direction, in view of the results of three-dimensional fluid analysis (this will be described later). The distance L2 between the front wall surface 15 and the partition 2 is preferably set to be, for example, one-third of the overall length L of the ballast tank or less.

Figure 12:
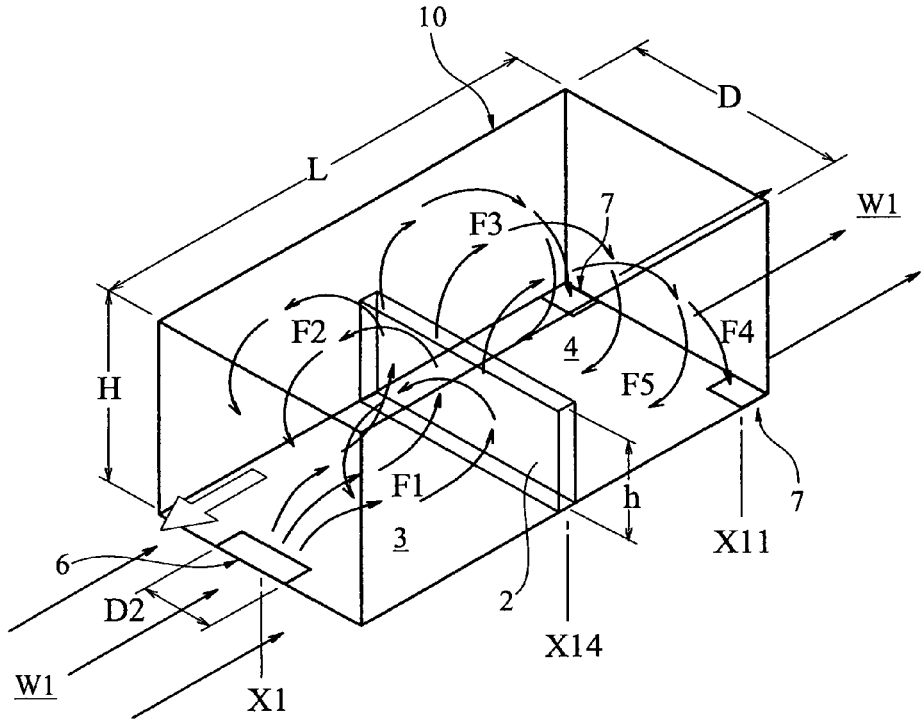
FIG. 12 is a perspective view schematically showing a structure of the ballast tank wherein the width of the inflow port is increased.
Figure 13:
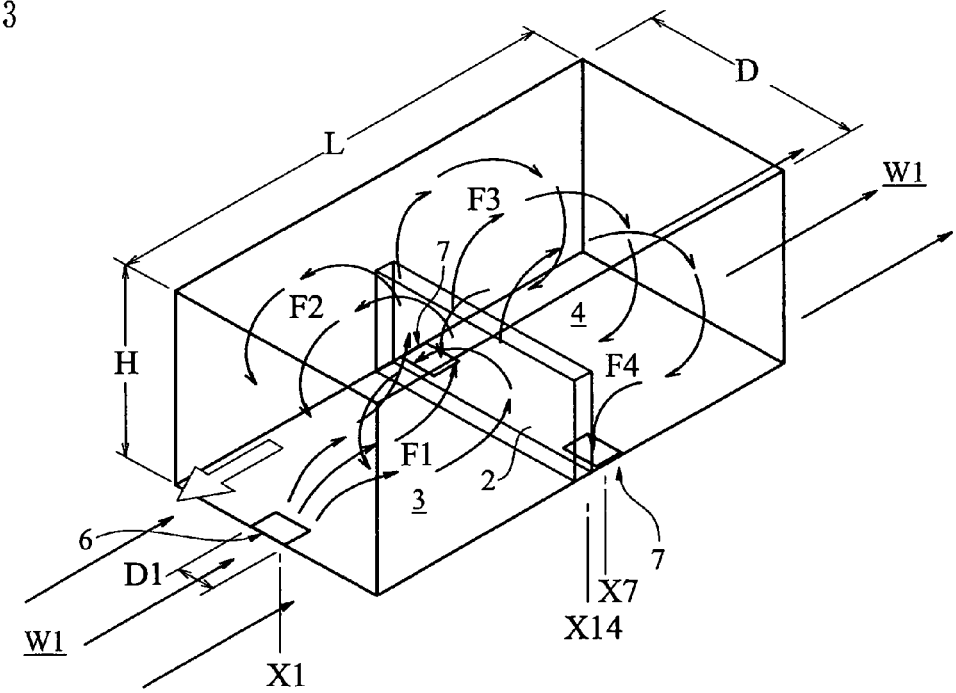
FIG. 13 is a perspective view schematically showing a structure of the ballast tank, wherein the outflow port is located at a position close to a rear face of the partition.
Figure 14:
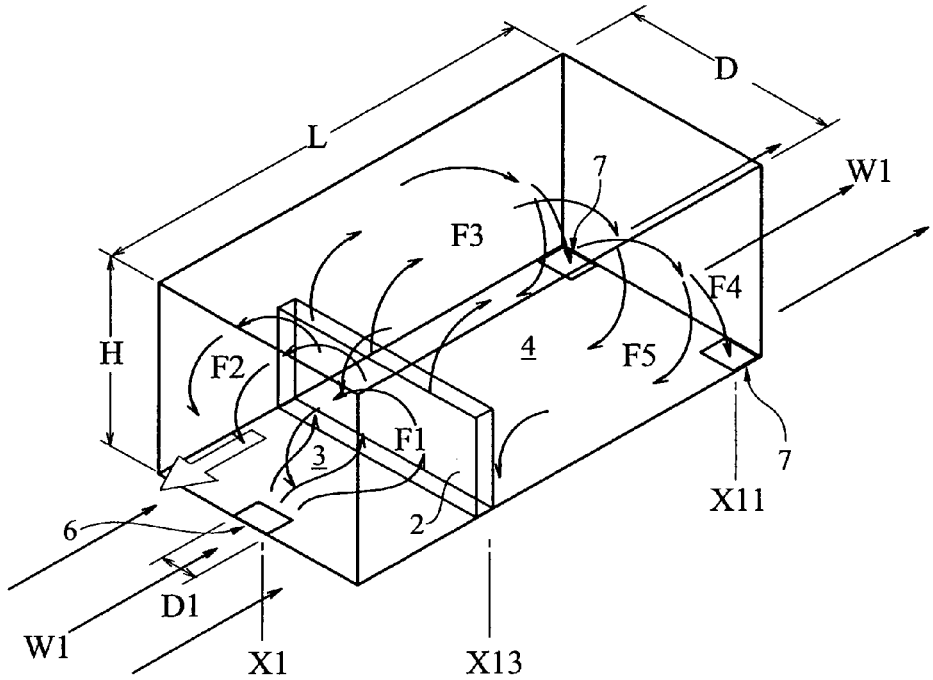
FIG. 14 is a perspective views schematically showing a structure of the ballast tank, wherein the position of partition is shifted forward.

FIGS. 12, 13, and 14 are perspective views schematically showing the structure of the ballast tank 10.

In the ballast tank 10 shown in FIG. 12, the partition 2 is located in the position X14 (FIG. 1), and the inflow port 6 and the outflow port 7 are located in the positions X1 and X11 (FIG. 10), respectively. The present inventor has conducted three-dimensional fluid analysis under the condition that the width of the inflow port 6 is increased from dimension D1 to dimension D2. When the dimension D2 is twice the dimension D1 (the width is increased from 2 m to 4 m), the seawater exchange rate obtained after 300 seconds of navigation of the ship increases by approximately 65%.

In the ballast tank 10 shown in FIG. 13, the partition 2 is located in the position X14 and the inflow port 6 is located in the position X1. The present inventor has conducted the three-dimensional fluid analysis under the condition that the position of the outflow ports 7 is changed from X11 to X7 (FIG. 10). When the position of the outflow ports 7 is changed from X11 to X7, the seawater exchange rate obtained after 300 seconds of navigation of the ship increases by approximately 45%.

In FIG. 14, the inflow port 6 and the outflow ports 7 are located in the positions X1 and X11, respectively. The present inventor has conducted the three-dimensional fluid analysis under the condition that the position of the partition 2 is changed from X14 to X13 (FIG. 11). When the position of the partition 2 is changed from X14 to X13, the seawater exchange rate obtained after 300 seconds of navigation of the ship increases by approximately 50%.

Figure 15:
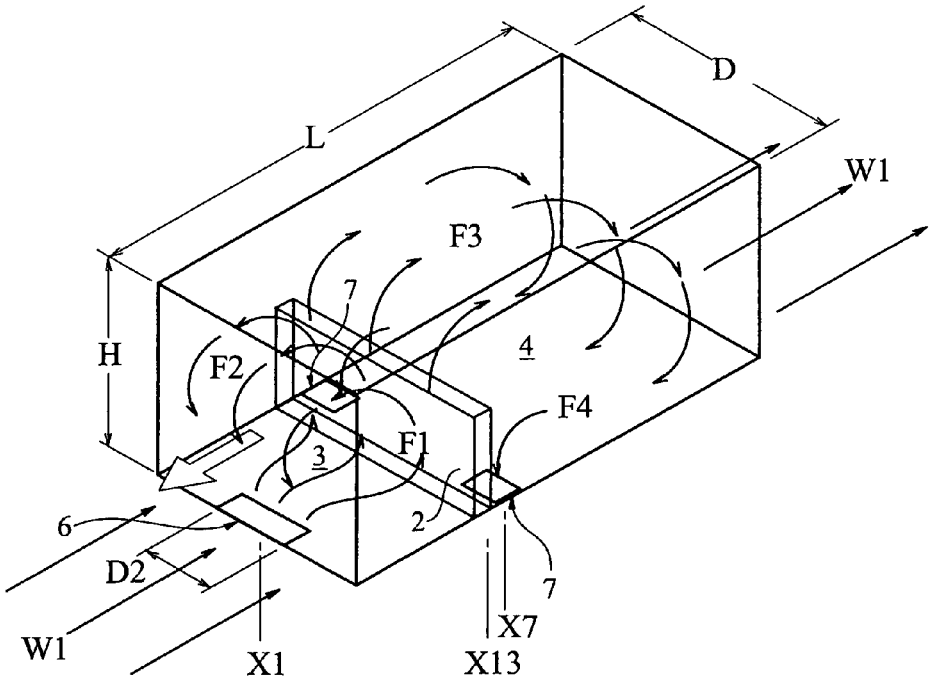
FIG. 15 is a perspective view schematically showing a structure of the ballast tank, wherein the width of the inflow port is increased, the outflow port is located at the position close to the rear face of the partition, and the position of partition is shifted forward.

FIG. 15 is a perspective view schematically showing an example of a configuration of a preferred ballast tank 10 which is designed, based on the results of analysis as set forth above.

The ballast tank 10 has the partition 2 located in the position X13, the inflow port 6 and the outflow ports 7 located in the positions X1 and X7, respectively, and the width of the inflow port 6 is enlarged from the dimension D1 to the dimension D2.

Figure 24:
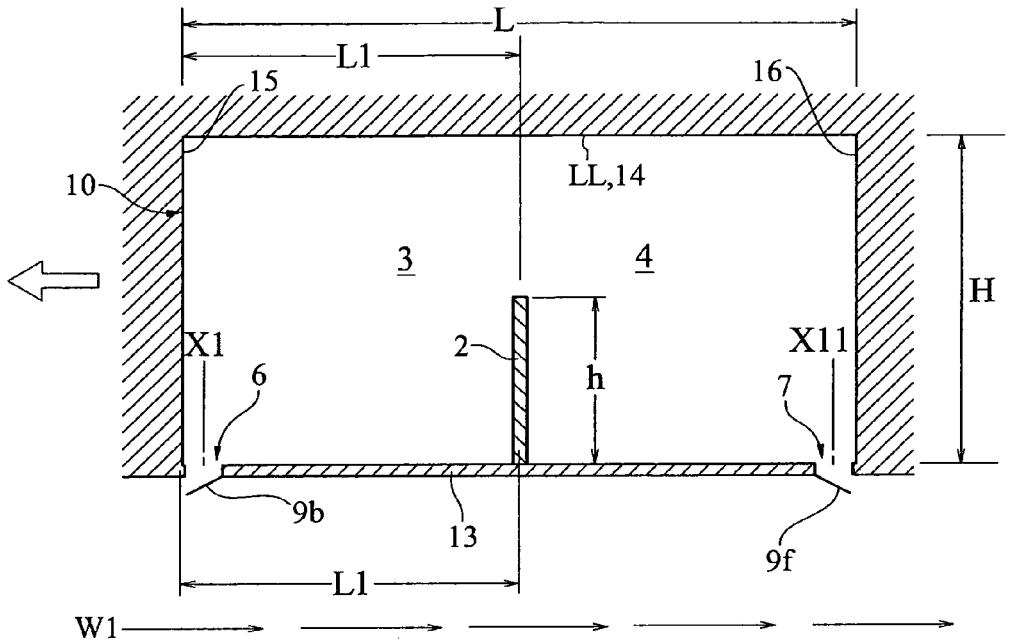
FIG. 24 includes a schematic longitudinal cross-section view and a diagram showing change of the seawater exchange rate in relation to change in the height of partition.
Figure 24:
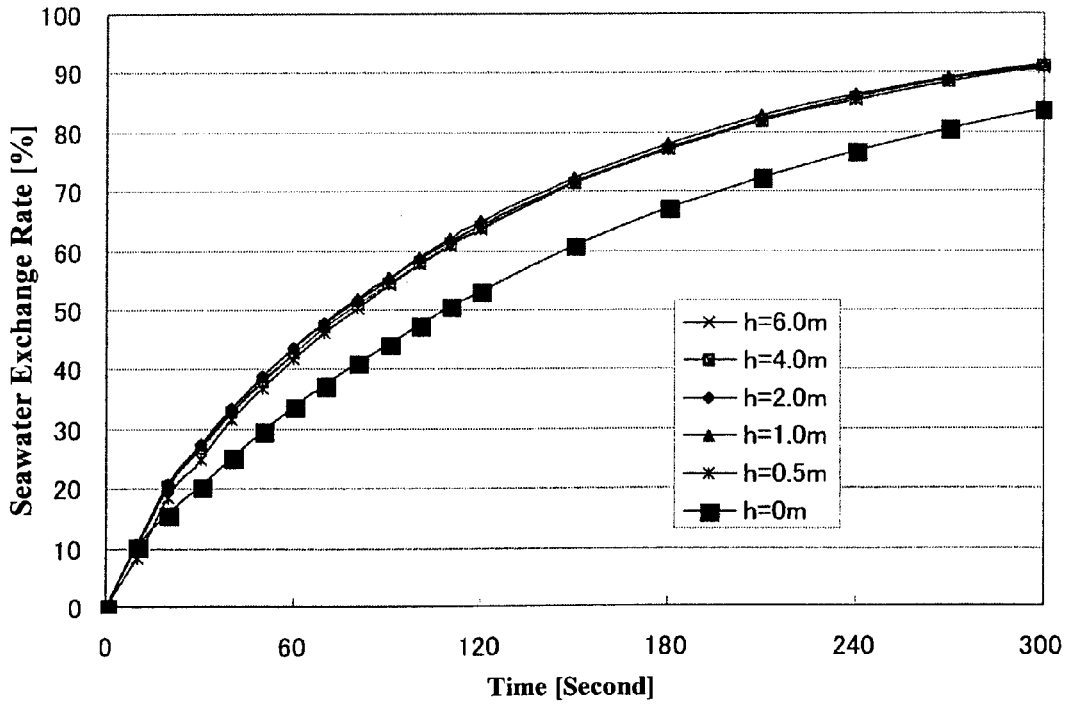

FIG. 24 includes a schematic longitudinal cross-sectional view and a diagram for explaining change in the seawater exchange rate in relation to change in the height of the partition 2.

The present inventor has studied change with time in the seawater exchange rate in relation to change in the height of the partition 2 in accordance with the two-dimensional fluid analysis under the conditions that the inflow port 6 with the outer-lid 9*b* and the outflow ports 7 with the outer-lid 9*f* are located in the positions X1 and X11, respectively, and that the partition 2 is located in a position L1 in the ballast tank 10, as shown in FIG. 24(A). FIG. 24(B) shows the results of the study. In the two-dimensional fluid analysis, the present inventor has set the headway speed of the ship to be 15 knots; set the dimensions L, L1, and H shown in FIG. 24(A) to be 20 m, 10 m, and 10 m, respectively; and changed the height h of the partition 2 in a range from 0 to 6 m.

As shown in FIG. 24(B), the seawater exchange rate exceeds 90% (after 300 seconds has elapsed) when the height h of the partition is equal to or greater than 0.5 m. In a case where the conditions that the inflow port 6 with the outer-lid 9*b* and the outflow ports 7 with the outer-lid 9*f* are located in the positions X1 and X11 respectively, the seawater exchange rate exceeds 80% (after 300 seconds has elapsed), even when the height h of the partition is equal to 0 m (i.e., no weir is provided). This result means that an adequate seawater exchange rate can be obtained by appropriate setting of the positions and structures of the openings, even if the height h of the partition is set to be a small value or the partition (weir)

is completely omitted. In such a case, it is desirable that the inflow port 6 has a large width (e.g., 2 m) and that the outflow ports 7 are disposed at the right and left bilge portions, as shown in FIG. 12.

Preferred examples of this invention has been described in detail, but the invention is not limited thereto. A variety of variations can be implemented or a variety of changes can be made in the scope of the invention set forth in the claims.

Figure 16:
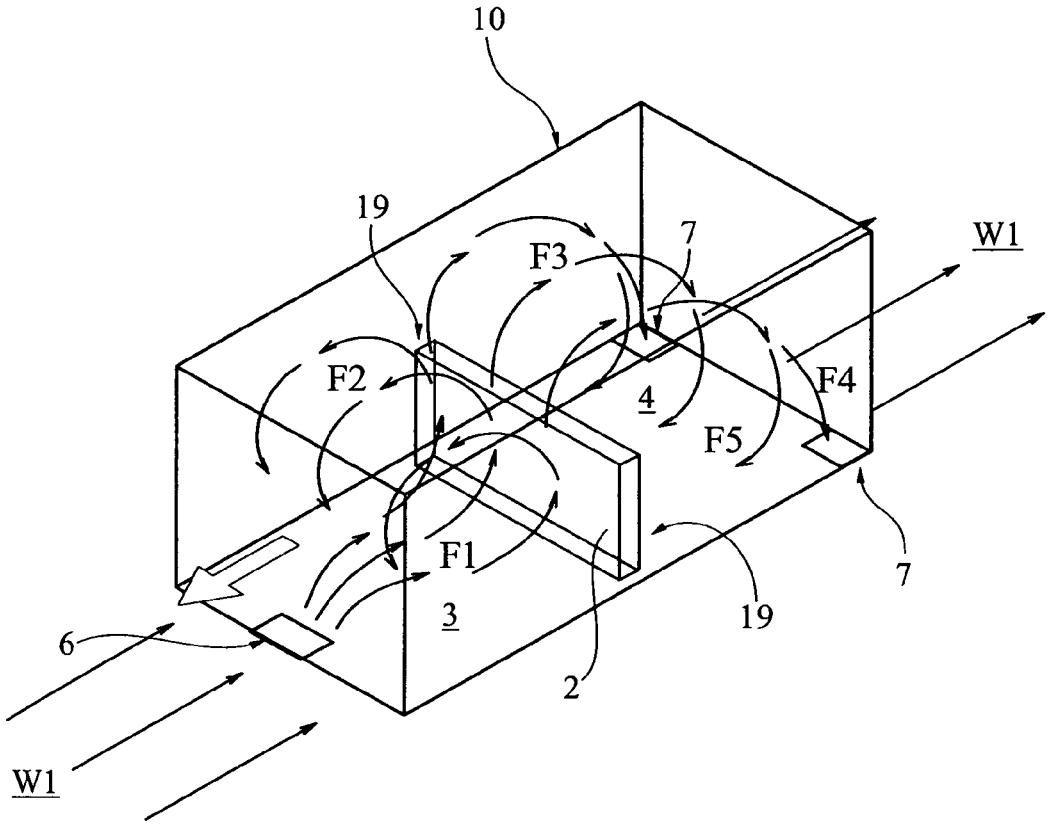
FIG. 16 is a perspective view schematically showing a structure of the ballast tank, wherein vertical slits are formed on both sides of the partition.

For example, a vertical slit 19 can be formed on both sides of the partition 2, as shown in FIG. 16.

The configuration, structure, dimension, and other parameters of the partition 2, the inflow port 6, the outflow ports 7, and the ballast tank 10 can be changed appropriately in accordance with the invention.

Further, while in the examples as described above, the inflow port 6 is disposed in the center part of the hull and the outflow ports 7 are disposed at the right and left bilge portions 8 from the viewpoint of improvement in the seawater exchange rate, the inflow port 6 and the outflow ports 7 are not necessarily disposed in the center part of the hull and the bilge portions 8, respectively, but can be disposed appropriately in accordance with the hull structure and other factors.

Further, although the examples as described above relates to the ballast water exchanger and the ballast water exchange method to which the technique of the present invention is applied, the technique of this invention can be applied to a hull structure and a hull buoyancy control method which do not rely on holding of the ballast water in a ballast tank.

INDUSTRIAL APPLICABILITY

The present invention is applied to a ballast water exchanger and a ballast water exchange method for exchanging ballast water in a ballast tank with seawater outside a ship during a voyage. This invention not only allows the ballast water to be exchanged for seawater with a simple arrangement without depending on a forced circulation apparatus or any other powered apparatus but also allows a high exchange rate of ballast water and seawater to be achieved.

The concept of the invention is also applicable to a hull structure and a hull buoyancy control method for reducing the hull buoyancy during a voyage when the ship is not loaded or lightly loaded. The hull structure and the hull buoyancy control method of the invention allow the hull buoyancy to be controlled without depending on holding of the ballast water in the ballast tank.

The invention claimed is:

1. A ballast water exchanger for a ship with a ballast tank, comprising:

a partition provided in the ballast tank with an upper portion of the partition being open, and an inflow port and an outflow port which are open through a bottom of the ship;

wherein the partition forms a weir extending in a widthwise direction of a hull in the ballast tank, and divides a region in the ballast tank into an inflow area located in front in a headway direction of the hull and an outflow area located in rear in the headway direction of the hull;

wherein a height of the partition is at least 0.2 times an overall height of the ballast tank; and wherein the inflow port is disposed in the inflow area, and the outflow port is disposed in the outflow area, and the inflow area and the outflow area are spaced apart from each other in the headway direction of the hull so that forward motion of the hull causes seawater outside the ship to flow into the ballast tank through the inflow port and the seawater in the ballast tank to flow out of the ship through the outflow port to create circulation flow of the seawater in the ballast tank.

2. A ballast water exchange method for exchanging ballast water in a ballast tank for seawater outside a ship during a voyage comprising:

partitioning a region in the ballast tank into an inflow area located in front in a headway direction of a hull and an outflow area located in rear in the headway direction of the hull by a weir extending in a widthwise direction of the hull, and providing an inflow port and an outflow port in positions, which are open through a bottom of the ship, in the inflow area and the outflow area respectively;

wherein the seawater outside the ship is introduced into the ballast tank through the inflow port to be taken therein and the seawater in the ballast tank is discharged from the ship through the outflow port, due to a difference in water pressure between the inflow port and the outflow port produced when the hull travels forward, so that circulation flow of the seawater is created in the ballast tank; and wherein a turning flow of the seawater circulating around an axis extending in the widthwise direction of the hull is generated in each of the inflow area and the outflow area.

3. A hull structure of a ship for reducing hull buoyancy during a voyage in an unloaded or lightly loaded condition, comprising:

a seawater circulating tank having an openable inflow port and an openable outflow port provided at a bottom of the ship, wherein the inflow port is located forward of the outflow port in a headway direction of a hull, the outflow port is located rearward of the inflow port in the headway direction of the hull, spaced apart from the inflow port by a distance, and the inflow and outflow ports are positioned under a sea surface level normally during the voyage; and wherein closure means is provided on the inflow port and the outflow port, the closure means opens the inflow port and the outflow port during a voyage in an unloaded or lightly loaded condition, the ports and the closure means opening the ports are so configured or positioned as to passively create a difference in water pressure between the inflow port and the outflow port to passively cause seawater outside the ship to be taken into the tank through the inlet port, circulated in the tank and discharged from the tank through the outlet port, and the closure means closes the inflow port and the outflow port during a voyage of the ship loaded with cargo, so that hull buoyancy is provided by air in the tank.

4. A hull buoyancy control method for reducing hull buoyancy during a voyage in an unloaded or lightly loaded condition of a ship, comprising:

using a seawater circulating tank provided with an inflow port and an outflow port located at a bottom of the ship, the inflow port and the outflow port being positioned under a sea surface level normally during the voyage and spaced apart from each other by a distance in a headway direction of a hull;

opening the inflow port and the outflow port through the bottom of the ship during a voyage in the unloaded or lightly loaded condition so that seawater outside the ship circulates in the tank to create circulation flow of the seawater therein; and closing the inflow port and the outflow port by closure means during a voyage of the ship loaded with cargo so that the hull buoyancy is provided by air in the tank, wherein the ports and the closure means opening the ports are so configured or positioned as to passively create difference in water pressure between the inflow port and the outflow port for passively causing the seawater outside the ship to be taken into the tank through the inlet port, circulated in the tank and discharged from the tank through the outlet port.

5. A hull structure as defined in claim 3, wherein the seawater circulating tank is partitioned into an inflow area and an outflow area by a weir extending in a widthwise direction of the hull, and said inflow port and said outflow port are located in the inflow area and the outflow area, respectively.

6. A hull buoyancy control method as defined in claim 4, wherein the seawater circulating tank is partitioned into an inflow area and an outflow area by a weir extending in a widthwise direction of the hull, and said inflow port and said outflow port are located in the inflow area and the outflow area, respectively.

7. A ballast water exchanger for a ship with a ballast tank, comprising:

a partition provided in the ballast tank with an upper portion of the partition being open, and an inflow port and an outflow port which are open through a bottom of the ship;

wherein the partition forms a weir extending in a widthwise direction of a hull in the ballast tank, and divides a region in the ballast tank into an inflow area located in front in a headway direction of the hull and an outflow area located in rear in the headway direction of the hull;

wherein the inflow port is disposed in the inflow area, and the outflow port is disposed in the outflow area, and the inflow area and the outflow area are spaced apart from each other in the headway direction of the hull so that forward motion of the hull causes seawater outside the ship to flow into the ballast tank through the inflow port and the seawater in the ballast tank to flow out of the ship through the outflow port to create circulation flow of the seawater in the ballast tank, and wherein said inflow port is disposed in a widthwise center part of the bottom of the ship, and said outflow ports are disposed at right and left bilge portions, respectively.

8. A ballast water exchanger for a ship with a ballast tank, comprising:

a partition provided in the ballast tank with an upper portion of the partition being open, and an inflow port and an outflow port which are open through a bottom of the ship;

wherein the partition forms a weir extending in a widthwise direction of a hull in the ballast tank, and divides a region in the ballast tank into an inflow area located in front in a headway direction of the hull and an outflow area located in rear in the headway direction of the hull;

wherein the inflow port is disposed in the inflow area, and the outflow port is disposed in the outflow area, and the inflow area and the outflow area are spaced apart from each other in the headway direction of the hull so that forward motion of the hull causes seawater outside the ship to flow into the ballast tank through the inflow port and the seawater in the ballast tank to flow out of the ship through the outflow port to create circulation flow of the seawater in the ballast tank, and wherein a distance (L1) between a front wall surface of said ballast tank and said partition is set to be a value equal to or less than one-third of a total length (L) of the ballast tank measured in a longitudinal direction of the hull.

9. A ballast water exchanger as defined in claim 1, further comprising seawater introducing means for introducing the seawater into the ballast tank so as to raise a water surface in the tank up to a level above a draft line, and closure means for closing said inflow port and said outflow port, wherein a top wall surface of said ballast tank is located above the draft line.

10. A ballast water exchanger as defined in claim 9, further comprising vent means for causing an upper area in the ballast tank to be in communication with atmosphere so as to lower the water surface down to a level lower than said draft line.

11. A hull structure of a ship for reducing hull buoyancy during a voyage in an unloaded or lightly loaded condition, comprising:

a seawater circulating tank having an openable inflow port and an openable outflow port provided at a bottom of the ship, wherein the inflow port is located forward of the outflow port in a headway direction of a hull, and the outflow port is located rearward of the inflow port in the headway direction of the hull, spaced apart from the inflow port by a distance; and wherein closure means is provided on the inflow port and the outflow port, the closure means opens the inflow port and the outflow port during a voyage in an unloaded or lightly loaded condition so that difference in water pressure between the inflow port and the outflow port causes in the tank, circulation of flow seawater outside the ship, and the closure means closes the inflow port and the outflow port during a voyage of the ship loaded with cargo, so that hull buoyancy is provided by means of air in the tank, wherein said inflow port is disposed at a widthwise center part of the bottom of the ship, and said outflow ports are disposed at right and left bilge portions, respectively.

12. A hull structure as defined in claim 3, wherein said closure means includes an outer lid on an inflow side which is openable to direct an opening of said inflow port forward of the hull, and an outer lid on an outflow side which is openable to direct an opening of said outflow port rearward of the hull.

13. A ship hull structure of a ship for reducing hull buoyancy during a voyage in an unloaded or lightly loaded condition, comprising:

a seawater circulating tank having an openable inflow port and an openable outflow port provided at a bottom of the ship;

wherein the inflow port is located forward of the outflow port in a headway direction of a hull, and the outflow port is located rearward of the inflow port in the headway direction of the hull, spaced apart from the inflow port by a distance;

wherein closure means is provided on the inflow port and the outflow port, the closure means opens the inflow port and the outflow port during a voyage in an unloaded or lightly loaded condition so that difference in water pressure between the inflow port and the outflow port causes in the tank, circulation of flow seawater outside the ship, and the closure means closes the inflow port and the outflow port during a voyage of the ship loaded with cargo, so that hull buoyancy is provided by means of air in the tank;

wherein the seawater circulating tank is partitioned into an inflow area and an outflow area by a weir extending in a widthwise direction of the hull, and said inflow port and said outflow port are located in the inflow area and the outflow area, respectively, and wherein a distance (L1) between a front wall surface of said tank and said weir is set to be a value equal to or less than one-third of an overall length (L) of the tank in a longitudinal direction of the hull.

14. A hull structure of a ship for reducing hull buoyancy during a voyage in an unloaded or lightly loaded condition, comprising:

a seawater circulating tank having an openable inflow port and an openable outflow port provided at a bottom of the ship;

wherein the inflow port is located forward of the outflow port in a headway direction of a hull, and the outflow port is located rearward of the inflow port in the headway direction of the hull, spaced apart from the inflow port by a distance;

wherein closure means is provided on the inflow port and the outflow port, the closure means opens the inflow port and the outflow port during a voyage in an unloaded or lightly loaded condition so that difference in water pressure between the inflow port and the outflow port causes in the tank, circulation of flow seawater outside the ship, and the closure means closes the inflow port and the outflow port during a voyage of the ship loaded with cargo, so that hull buoyancy is provided by means of air in the tank;

wherein the seawater circulating tank is partitioned into an inflow area and an outflow area by a weir extending in a widthwise direction of the hull, and said inflow port and said outflow port are located in the inflow area and the outflow area, respectively, and wherein a height (h) of said weir is set to be at least H'0.2, where H represents an overall height of said tank.

15. A hull buoyancy control method for reducing hull buoyancy during a voyage in an unloaded or lightly loaded condition of a ship, comprising:

using a seawater circulating tank provided with an inflow port and an outflow port located at a bottom of the ship, the inflow port and the outflow port spaced apart from each other by a distance in a headway direction of a hull;

opening the inflow port and the outflow port through the bottom of the ship during a voyage in the unloaded or lightly loaded condition so that difference in water pressure between the inflow port and the outflow port causes seawater outside the ship to circulate in the tank to create circulation flow of the seawater therein; and closing the inflow port and the outflow port by closure means during a voyage of the ship loaded with cargo so that the hull buoyancy is provided by air in the tank, wherein the seawater circulating tank is partitioned into an inflow area and an outflow area by a weir extending in a widthwise direction of the hull, and said inflow port and said outflow port are located in the inflow area and the outflow area, respectively, and wherein turning flow of the seawater circulating around an axis extending in the widthwise direction of the hull are generated in each of the inflow area and the outflow area.

16. A hull buoyancy control method as defined in claim 4, wherein outer lids are equipped on the inflow port and the outflow port to provide said closure means, and wherein an opening of the inflow port is directed forward of the hull by opening said lid on the inflow port, and an opening of the outflow port is directed rearward of the hull by opening said lid on the outflow port.

17. A control method as defined in claim 4, wherein the hull is caused to travel forward in a condition that a water surface level in the tank is raised above a draft line.

18. A hull structure as defined in claim 3, further comprising vent means for causing an upper area in the ballast tank to be in communication with atmosphere.

19. A hull buoyancy control method as defined in claim 4, wherein an upper area in the ballast tank is caused to be in communication with atmosphere by vent means.

* * * * *

UNITED STATES PATENT AND TRADEMARK OFFICE

CERTIFICATE OF CORRECTION

PATENT NO. : 7,921,790 B2
APPLICATION NO. : 12/448112
DATED : April 12, 2011
INVENTOR(S) : Makoto Arai et al.

It is certified that error appears in the above-identified patent and that said Letters Patent is hereby corrected as shown below:

Column 16, Line 5, In Claim 2, delete "voyage" and insert -- voyage, --, therefor.

Signed and Sealed this
Eighteenth Day of October, 2011

David J. Kappos

David J. Kappos
*Director of the United States Patent and Trademark Office*